US006494260B2

(12) United States Patent
van Petegem et al.

(10) Patent No.: US 6,494,260 B2
(45) Date of Patent: Dec. 17, 2002

(54) SINGLE TRIP PERFORATING AND FRACTURING/GRAVEL PACKING

(75) Inventors: Ronald van Petegem, Velserbroek (NL); Colby M. Ross, Carrollton, TX (US)

(73) Assignee: Halliburton Energy Services, Inc., Dallas, TX (US)

( * ) Notice: Subject to any disclaimer, the term of this patent is extended or adjusted under 35 U.S.C. 154(b) by 50 days.

(21) Appl. No.: 09/754,799

(22) Filed: Jan. 4, 2001

(65) Prior Publication Data

US 2001/0015275 A1 Aug. 23, 2001

Related U.S. Application Data

(62) Division of application No. 09/409,780, filed on Sep. 29, 1999.

(51) Int. Cl.[7] ..... E21B 43/04

(52) U.S. Cl. ..... 166/278; 166/297; 166/51; 166/55.1

(58) Field of Search ..... 166/278, 297, 166/298, 51, 55.1

(56) References Cited

U.S. PATENT DOCUMENTS

| | | | | |
|---|---|---|---|---|
| 4,566,538 A | * | 1/1986 | Peterson | 166/278 |
| 4,633,951 A | | 1/1987 | Hill et al. | |
| 4,905,759 A | | 3/1990 | Wessaon et al. | |
| 4,944,348 A | | 7/1990 | Whiteley et al. | |
| 4,951,750 A | * | 8/1990 | Wetzel, Jr. | 166/278 |
| 5,174,379 A | | 12/1992 | Whiteley et al. | |
| 5,287,924 A | | 2/1994 | Burleson et al. | |
| 5,355,957 A | | 10/1994 | Burleson et al. | |
| 5,845,712 A | | 12/1998 | Griffith, Jr. | |
| 5,865,252 A | * | 2/1999 | van Petegem et al. | 166/297 |
| 5,975,205 A | | 11/1999 | Carisella | |
| 6,012,525 A | | 1/2000 | Burleson et al. | |
| 6,055,213 A | * | 4/2000 | Rubbo et al. | 367/82 |
| 6,076,601 A | | 6/2000 | Mooney, Jr. | |
| 6,125,933 A | | 10/2000 | Ross | |
| 6,125,946 A | | 10/2000 | Chen | |
| 6,131,662 A | * | 10/2000 | Ross | 166/369 |
| 6,173,779 B1 | | 1/2001 | Smith | |
| 6,206,100 B1 | * | 3/2001 | George et al. | 166/278 |
| 6,216,785 B1 | * | 4/2001 | Achee, Jr. et al. | 166/278 |
| 6,286,598 B1 | * | 9/2001 | van Petegem et al. | 166/297 |

OTHER PUBLICATIONS

Halliburton Sand Control Catalog, pp. 4–11, 4–12, 4–13, 4–14 and 4–15, undated.

SPE 39434, New Single Trip Perfprating and Gravel Pack Procedure with Advanced Stimulation Design Reduces Formation Damage in High Permeability Sandstone Reservoirs: Case Histories, copyright 1998.

SPE 39486, Successful Completions in the Gulf of Mexico Using the Single–Trip Perforation and Packing System, copyright 1998.

SPE 54285, Single Trip Perforating and Gravel Pack System Reduces Formation Damage in Offshore Gulf of Mexico Wells: Case Histories and Guidelines for Candidate Selection, copyright 1999.

* cited by examiner

*Primary Examiner*—William Neuder
(74) *Attorney, Agent, or Firm*—William M. Imwalle; Marlin R. Smith

(57) ABSTRACT

A well completion system and associated methods of completing wells provides enhanced convenience in well completions involving well treatment operations. In a described embodiment, a single trip perforating and fracturing/gravel packing method permits a well completion assembly including a well screen and a perforating gun to be installed in a well, the well to be perforated and treated, and the perforating gun to be retrieved from the well in a single trip. Retrieval of the perforating gun permits multiple zone completions in the well without the perforating guns remaining in the well thereafter.

17 Claims, 20 Drawing Sheets

SINGLE TRIP PERFORATING AND FRACTURING/GRAVEL PACKING

This is a division, of application Ser. No. 09/409,780, filed Sep. 29, 1999, such prior application being incorporated by reference herein in its entirety.

BACKGROUND OF THE INVENTION

The present invention relates generally to equipment and operations utilized in conjunction with subterranean wells and, in an embodiment described herein, more particularly provides a single trip perforating and fracturing/gravel packing method.

In well completion operations, it is very beneficial to minimize the number of trips into the well, since each trip into the well is typically time consuming, is expensed to the well operator, and increases the chances that damage will inadvertently be caused to the well, a fishing job will be needed, etc. Thus, service companies performing these completion operations generally strive to accomplish as many objectives as possible for each trip into the well.

One way of accomplishing multiple objectives in a single trip into the well is to combine various portions of the overall well completion. For example, in a cased well completion, it is generally necessary to perforate a casing or liner lining the wellbore, and it may be desired to also stimulate and/or gravel pack one or more perforated zones of the well. If the perforating and stimulation/gravel packing operations can be combined in a single trip into the well, the economics, speed and convenience of the well completion are enhanced.

It is well known to combine perforating and fracturing/gravel packing operations in a single trip into the well. In a typical combined operation, one or more perforating guns are suspended below a fracturing/gravel packing assembly and interconnected in a tubular string installed in the well. The perforating guns are positioned in the wellbore opposite a particular zone intersected by the well, the guns are fired to perforate the zone, and then the fracturing/gravel packing assembly is positioned opposite the perforated zone. The zone is fractured, or otherwise stimulated, and/or gravel packed as desired. The perforating guns remain attached to the fracturing/gravel packing assembly, or are dropped off in the well.

Unfortunately, it may be undesirable to leave the guns attached to the fracturing/gravel packing assembly, or to drop off the guns in the well. For example, the presence of the guns in the well may impede access to a portion of the well or the guns may restrict fluid flow in the well. Furthermore, it may be desired to perform other operations, such as additional perforating and/or fracturing/gravel packing operations, in close proximity to the prior completion operation, such as when multiple closely spaced zones are to be individually completed in the well. Additionally, in relatively horizontal portions of wells, the guns cannot generally be dropped off.

Note that perforating guns could be conveyed by wireline, electric line, coiled tubing, etc., in such operations, but this would require the additional wireline, electric line, etc. trip into the well, would require mobilization of the wireline, electric line, etc. rig, would not attain the performance advantages of tubing conveyed perforating guns, and would not resolve the problem of use in horizontal wells.

Thus, it may be seen that it would be quite advantageous to provide a well completion system and method which permit perforating guns to be retrieved from a well after a well completion operation. It would also be advantageous to provide such system and method wherein the benefits of tubing conveyed perforating are retained. Additionally, it would be desirable to provide such system and method with features which permit multiple closely spaced completions in the well. Furthermore, it would be advantageous to provide a well completion system which includes a perforating assembly which has an outer dimension that is reduceable in the well, so that at least a portion of the perforating assembly may be displaced through a restriction in the well after perforating.

Where multiple well completion operations are combined into a single trip into the well, it is frequently difficult to resolve the problem of how to control actuation of the various items of equipment installed downhole. For example, various packers may need to be set, one or more firing heads may need to be operated, etc. Thus, it may be seen that it would be beneficial to provide a well completion system and method which enhances the convenience and safety of such operations.

SUMMARY OF THE INVENTION

In carrying out the principles of the present invention, in accordance with an embodiment thereof, a method of completing a well is provided in which a perforating assembly and a well treatment assembly are interconnected in a tubular string and conveyed into the well. The method does not require that any perforating gun be dropped off in the well or otherwise remain in the well, but permits the perforating gun(s) to be retrieved from the well. Well completion systems are also provided, as well as methods which permit enhanced convenience and safety in operating various equipment associated with the systems.

In one aspect of the present invention, a method is provided which includes the steps of installing a perforating gun and a well treatment assembly in a well, and displacing the perforating gun through at least a portion of the well treatment assembly. The well treatment assembly may include a well screen, and the perforating gun may be displaced through an inner passage of the well screen. The perforating gun and well treatment assembly may be installed in the well, and the perforating gun retrieved from the well after firing, in a single trip into the well.

In another aspect of the present invention, a method is provided in which perforating guns are initially laterally spaced apart when installed in a well, and then are laterally compressed in the well. This method permits the guns to be retrieved side by side from the well through a portion of a well treatment assembly, while enabling the guns to be positioned in close proximity to a wall of the well when the guns are fired, for enhanced perforating performance.

In still another aspect of the present invention, a method is provided in which perforating guns are initially laterally spaced apart when installed in a well, and then are longitudinally spaced apart after the guns are fired. This method also permits the guns to be in close proximity to a wall of the well when fired, yet pass through a portion of a well treatment assembly portion after being fired. Other methods for decreasing a size of at least a portion of a perforating assembly downhole are provided as well.

In yet another aspect of the present invention, methods are provided for actuating various items of equipment of a well completion assembly. In one of these methods, a packer of a well treatment assembly is set by applying fluid pressure to a line, which line is also utilized to apply fluid pressure to a firing head for firing a perforating gun. In another of these methods, a series of fluid pressure applications are utilized to arm a packer. In still another of these methods, a signal comprising fluid pressure pulses is utilized to arm and/or set a packer.

These and other features, advantages, benefits and objects of the present invention will become apparent to one of ordinary skill in the art upon careful consideration of the detailed description of representative embodiments of the invention hereinbelow and the accompanying drawings.

DETAILED DESCRIPTION

Representatively illustrated in FIGS. 1A–1F is a well completion method 10 and associated well completion assembly 12 which embody principles of the present invention. In the following description of the method 10, assembly 12, and other apparatus and methods described herein, directional terms, such as "above", "below", "upper", "lower", etc., are used for convenience in referring to the accompanying drawings. Additionally, it is to be understood that the various embodiments of the present invention described herein may be utilized in various orientations, such as inclined, inverted, horizontal, vertical, etc., without departing from the principles of the present invention.

Figure 1A:
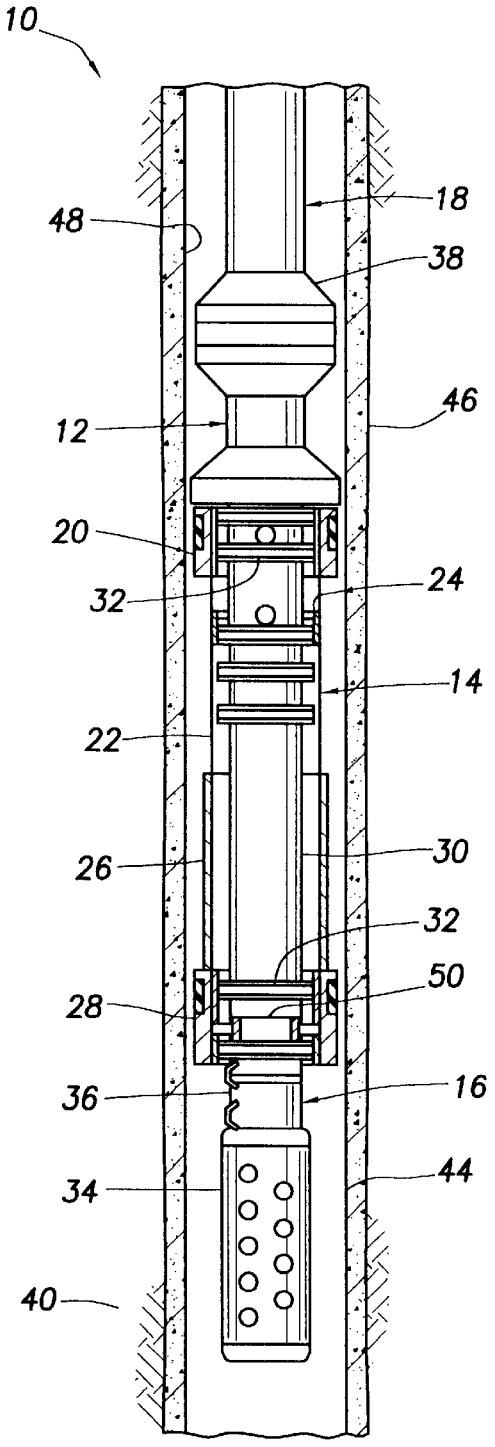
FIGS. 1A–1F are schematic cross-sectional views of a first well completion method and system embodying principles of the present invention.

The well completion assembly 12 includes a well treatment assembly 14 and a perforating assembly 16 interconnected in a tubular string 18. As depicted in FIG. 1A, the perforating assembly 16 is interconnected below the well treatment assembly 14 in the tubular string 18. However, it is to be clearly understood that it is not necessary for the perforating assembly 16 to be interconnected below the well treatment assembly 14 in keeping with the principles of the present invention.

The representatively illustrated well treatment assembly 14 is configured for fracturing and/or gravel packing the well. Accordingly, the well treatment assembly 14 includes an upper packer 20, an outer tubular housing 22, a well screen 26, a lower packer 28, a washpipe 30, seals 32, and a seal bore 24 in the washpipe for sealing engagement with various of the seals. A person skilled in the art will recognize that these elements are similar in many respects to components of typical fracturing and gravel packing assemblies, such as the FracPac system marketed by Halliburton Energy Services, Inc. However, it is not necessary for the well treatment assembly 14 to be configured for fracturing or gravel packing the well. For example, the well treatment assembly 14 may be configured for performing well stimulation operations such as acidizing, other types of operations, etc. Thus, it will be readily appreciated that the well treatment assembly 14 may include more, less, or other items of equipment, without departing from the principles of the present invention.

The perforating assembly 16 includes at least one perforating gun 34 and a firing head 36. A packer 38 associated with the perforating assembly 16 is interconnected in the tubular string 18 above the well treatment assembly 14. As described below in further detail, the perforating assembly 16 may include multiple guns 34, multiple firing heads 16, and other items of equipment not shown in FIGS. 1A–1F. Furthermore, the perforating assembly 16 may include other types of equipment, such as circulating valves, etc., without departing from the principles of the present invention.

As depicted in FIG. 1A, the completion assembly 12 is being positioned in the well opposite a zone 40 intersected by the well. As used herein, the term "zone" includes a subterranean formation, or portion of a formation, intersected by a well, and from, or into which, it is desired to produce or inject fluid via the well.

Figure 1B:
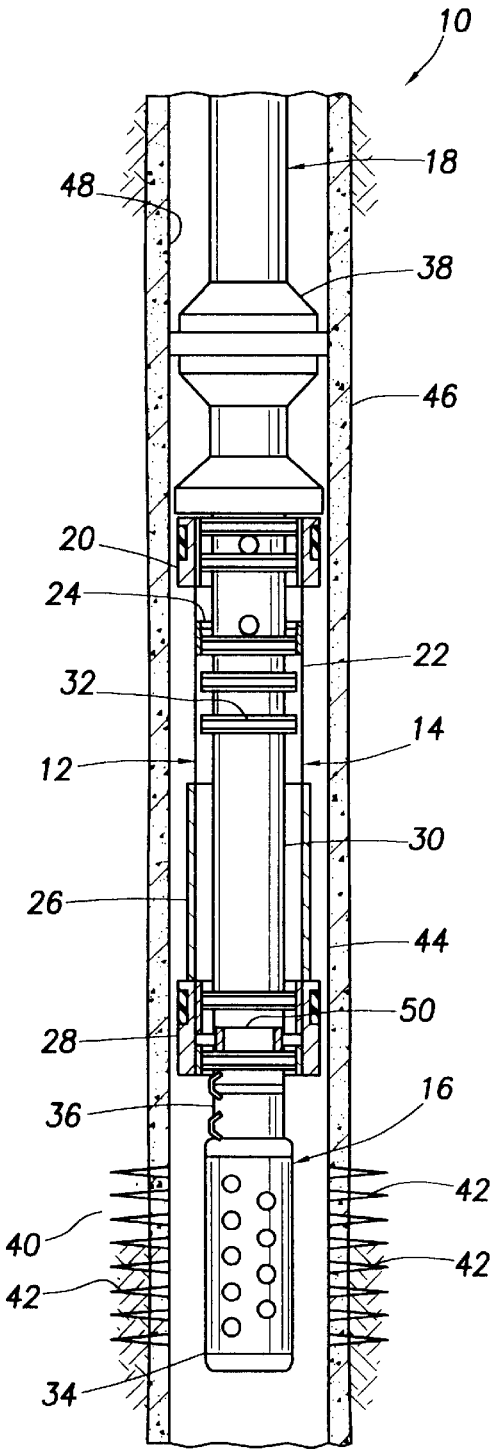

In FIG. 1B, the upper packer 38 has been set and the perforating gun 34 has been fired by actuating the firing head 36. Perforations 42 have thus been formed through casing 44 and cement 46 lining the wellbore 48 of the well. Fluid is now permitted to flow between the formation 40 and the wellbore 48 through the perforations 42.

Figure 1C:
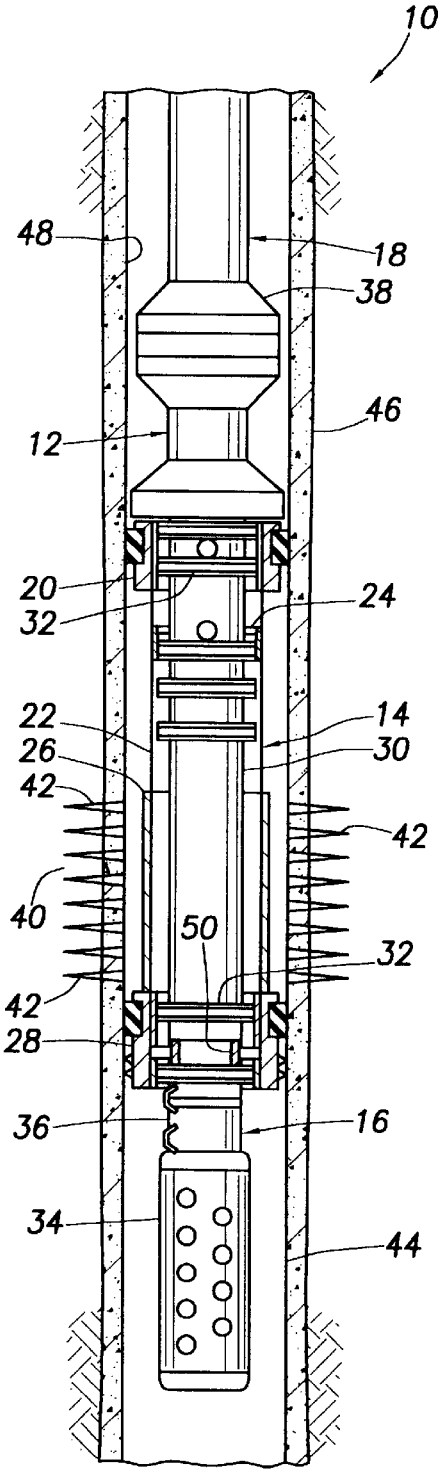

In FIG. 1C, the packer 38 has been unset, and the completion assembly 12 has been lowered in the wellbore 48. The treatment assembly 14 is now positioned opposite the perforations 42. The treatment assembly packers 20, 28 have been set straddling the perforations 42, so that the well treatment operations may now be performed. Note that the lower packer 28 may be set hydraulically by shifting a sleeve 50 selectively permitting fluid communication laterally through the washpipe 30 in the packer 28 between a pair of the seals 32. Fluid pressure may be applied to the tubing string 18 to set the packer 28, as well as the upper packer 20. Of course, other means and methods of setting the packers 20, 28 may be utilized without departing from the principles of the present invention.

Figure 1D:
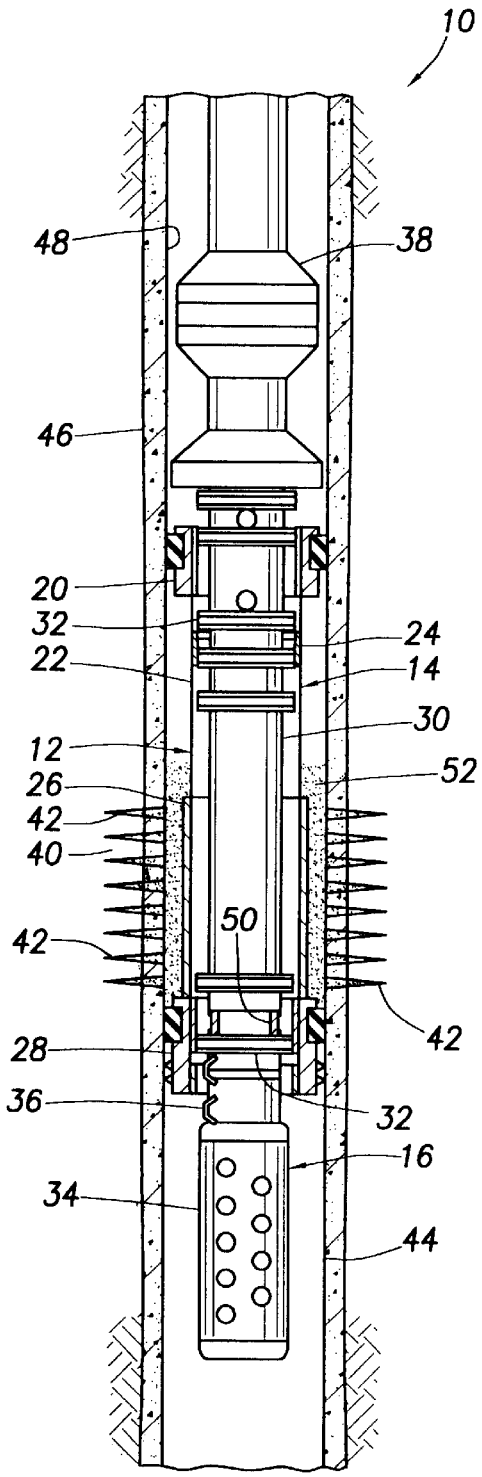

In FIG. 1D, the completion assembly 12 is shown after a gravel pack operation has been performed. Gravel 52 is now disposed in the wellbore 48 between the screen 26 and the casing 44, and in the perforations 42. Alternatively, or in addition, fracturing operations may have been performed, in which case proppant may be forced into fractures formed extending outwardly from the perforations 42. As noted above, however, it is not necessary in the method 10 for any particular well treatment operation to be performed. Other or additional well treatment operations may be performed in the method 10 without departing from the principles of the present invention.

Figure 1E:
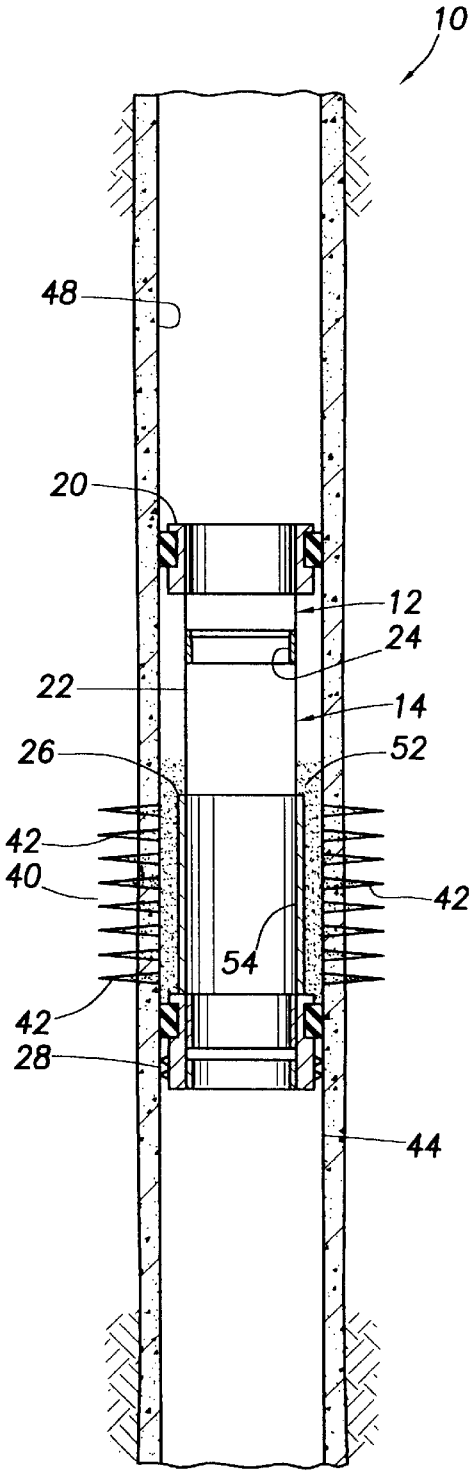

In FIG. 1E, the well treatment operation has been completed and a substantial portion of the completion assembly 12 has been retrieved from the well. Specifically, the perforating assembly 16 and the washpipe 30 and seals 32 have been retrieved from the well, leaving the screen 26, housing 22 and upper and lower packers 20, 28 in the well. Note that fluid may now be produced from the zone 40, and access to the remainder of the well below the well treatment assembly 14 may be had, via an inner passage 54 formed through the screen 26 and the remainder of the well treatment assembly left in the well.

Note that the perforating gun 34 has been retrieved from the well by displacing it upwardly through the inner passage 54 of the well treatment assembly 14. In this manner, the gun 34 is not left attached to the well treatment assembly 14, nor is it dropped off in the well. Thus, the method 10 may be conveniently and economically performed in highly deviated or substantially horizontal wells, and the method may be performed for well treatment operations in closely spaced zones.

Figure 1F:
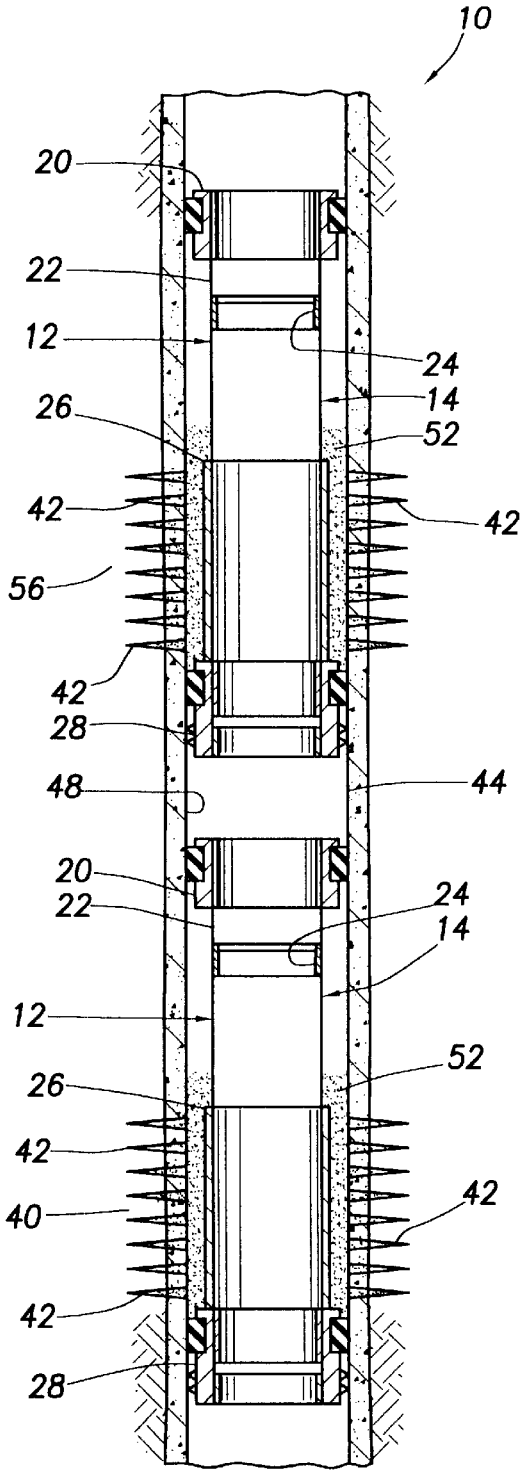

In FIG. 1F, the method 10 is shown wherein above described steps have been repeated to complete another zone 56 intersected by the well above the zone 40. The zone 56 is in close proximity to the previously completed zone 40. Additional zones may also be completed by repeating the above described steps of the method 10 as desired. For illustrative purposes, the zone 56 is depicted closer to the zone 40 than would be encountered in actual practice of the method 10. For example, sufficient space is preferably provided between the treatment assemblies 14 for the perforating assembly 16, but this is not necessary in keeping with the principles of the present invention.

It will be readily appreciated that the zone 56 is completed using a similar completion assembly 12 to that described above. Accordingly, elements of the completion assembly 12 used to complete the upper zone 56 are indicated using the same reference numbers as for the elements of the completion assembly used to complete the lower zone 40. However, it is to be clearly understood that more, less, or other items of equipment may be utilized in the completion of the zone 56, without departing from the principles of the present invention.

In the method 10, various packers may be set in various manners. For example, the upper and lower packers 20, 28 of the treatment assembly 14 may each be set hydraulically by applying fluid pressure to the tubular string 18 at the earth's surface after arming the packer. As used herein, the term "arm" is used to indicate action taken to permit actuation of an item of equipment by means which, if applied before arming, would not actuate the item of equipment. For example, the lower packer 28 may be armed by shifting the sleeve to permit fluid communication between the interior of the washpipe 30 and the packer between the seals 32 sealingly engaged in the packer.

Since fluid pressure applied to the tubular string 18 may in some circumstances be the preferred means of actuating one or more firing heads 36 of the perforating assembly 16, it may be beneficial to provide additional methods of arming and/or setting one or both of the packers 20, 28, so that the packers are not set when it is intended to fire the gun 34.

Figure 2:
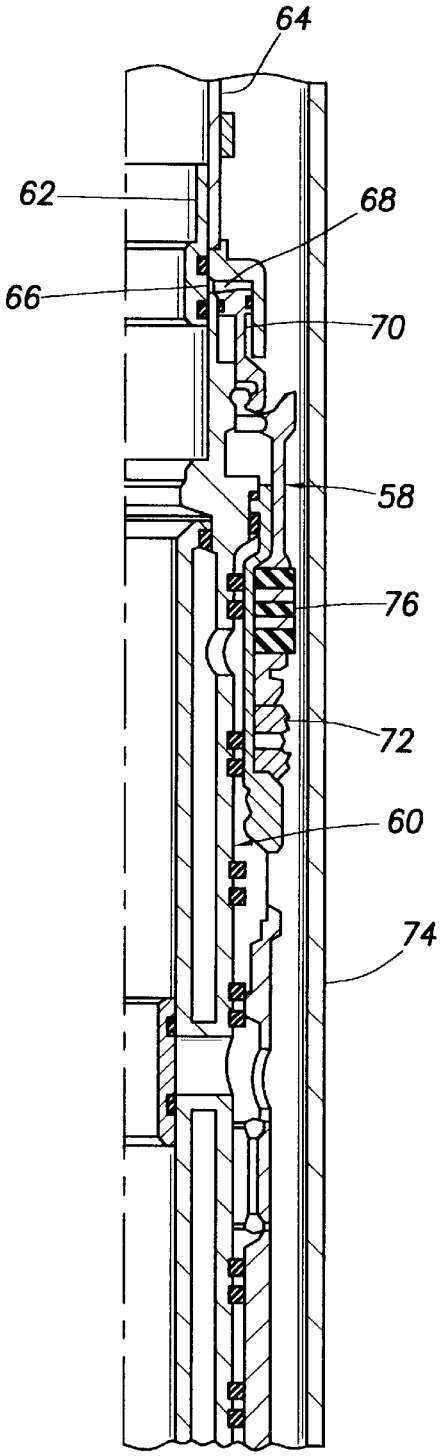
FIG.2 (PRIOR ART)
FIG. 2 (PRIOR ART) is a partial schematic cross-sectional view through a prior art packer and a portion of a well treatment assembly.

FIG. 2 depicts a prior art Versa-Trieve packer 58 and an associated Multi-Position Tool 60, both of which are available from Halliburton Energy Services, Inc. and are well known to those skilled in the art. The packer 58 and tool 60 are commonly used in well completion operations, and may be used in the well treatment assembly 14 described above.

The packer 58 is conventionally armed by engaging a sealing device, such as a ball, within a sleeve 62. Fluid pressure is then applied to a tubular string 64, thereby creating a pressure differential across the sealing device and sleeve 62. When a predetermined pressure differential is achieved, the sleeve 62 shifts downward, exposing an opening 66 to the fluid pressure in the tubular string 64. At this point, the packer 58 is armed. The fluid pressure enters an inner chamber 68 of the packer 58 and biases a piston 70 downward. Such downward displacement of the piston 70 causes slips 72 to grippingly engage casing 74 surrounding the packer 58, and causes seal elements 76 to sealingly engage the casing, thus setting the packer. Note that fluid pressure is used both to arm the packer 58 and to set the packer.

Figure 3:
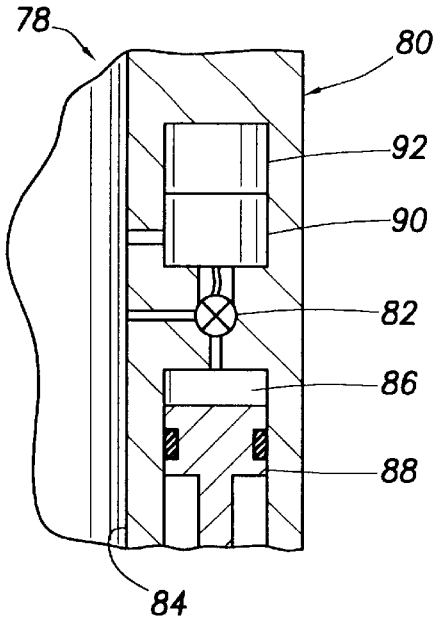
FIG. 3 is a schematic cross-sectional view of a portion of a first packer embodying principles of the present invention illustrating a method of arming and actuating same.

Referring additionally now to FIG. 3, a method 78 of arming a packer 80 embodying principles of the present invention is schematically and representatively illustrated. In the method 78, an electrically operated valve 82 is disposed initially preventing fluid communication between an inner axial flow passage 84 extending through the packer 80 and an inner chamber 86 of the packer. A piston 88 is reciprocably disposed in the chamber, so that, when sufficient fluid pressure is introduced into the chamber 86, the piston will displace downwardly to set the packer 80, in a manner similar to that in which downward displacement of the piston 70 is utilized to set the packer 58 described above.

Actuation of the valve 82 is controlled by a receiver or control module 90, with power supplied by a battery 92 or other power source. The receiver 90 may be responsive to a signal transmitted from a remote location. For example, conventional mud pulse telemetry techniques may be utilized to transmit a series of pressure pulses from the earth's surface or another remote location to the receiver. When an appropriate signal is received by the receiver 90, the valve 82 is opened, thus permitting fluid communication between the flow passage 84 and the chamber 86, and thus arming the packer 80. It is to be clearly understood that other means of transmitting an appropriate signal to the receiver 90, such as ultrasonics, radio frequency transmission, etc., may be utilized, without departing from the principles of the present invention. One acceptable means of opening a valve in response to a remotely transmitted signal is described in U.S. patent application Ser. No. 09/184,526, filed Nov. 2, 1998, and entitled Downhole Hydraulic Power Source, the disclosure of which is incorporated herein by this reference.

Figure 4:
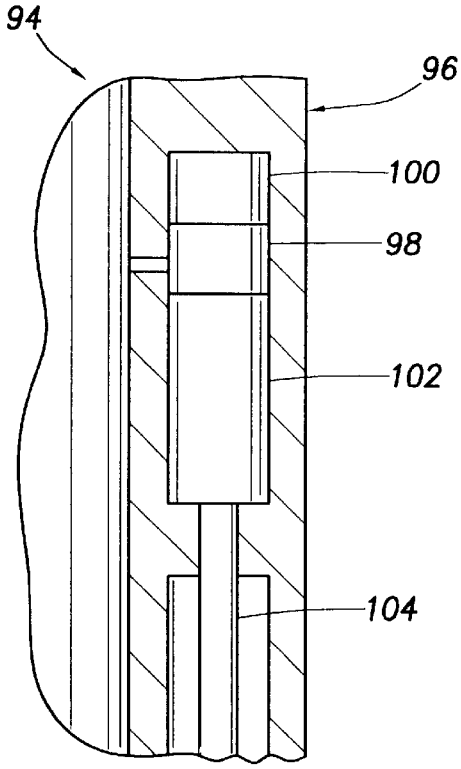
FIG. 4 is a schematic cross-sectional view of a portion of a second packer embodying principles of the present invention illustrating a method of actuating same.

Referring additionally now to FIG. 4, another method 94 of arming a packer 96 embodying principles of the present invention is schematically and representatively illustrated. The method 94 is similar in some respects to the method 78 described above, in that a receiver 98 and battery or other power source 100 are used to receive a remotely transmitted signal, but differs substantially in the manner in which the packer 96 is set after the signal is received.

In the method 94, a conventional electric linear actuator 102 is coupled to the receiver 98, so that, when the appropriate signal is received by the receiver, power is supplied to the linear actuator. When power is supplied to the linear actuator 102, a rod or other elongated member 104 is displaced downwardly, thereby setting the packer 96 in a manner similar to that in which downward displacement of the piston 70 sets the packer 58 described above. Note that the linear actuator 102 may be no more than a solenoid, or it may be a ball screw actuator, etc., or any other type of actuator which may displace a member in response to power applied thereto.

Figure 5:
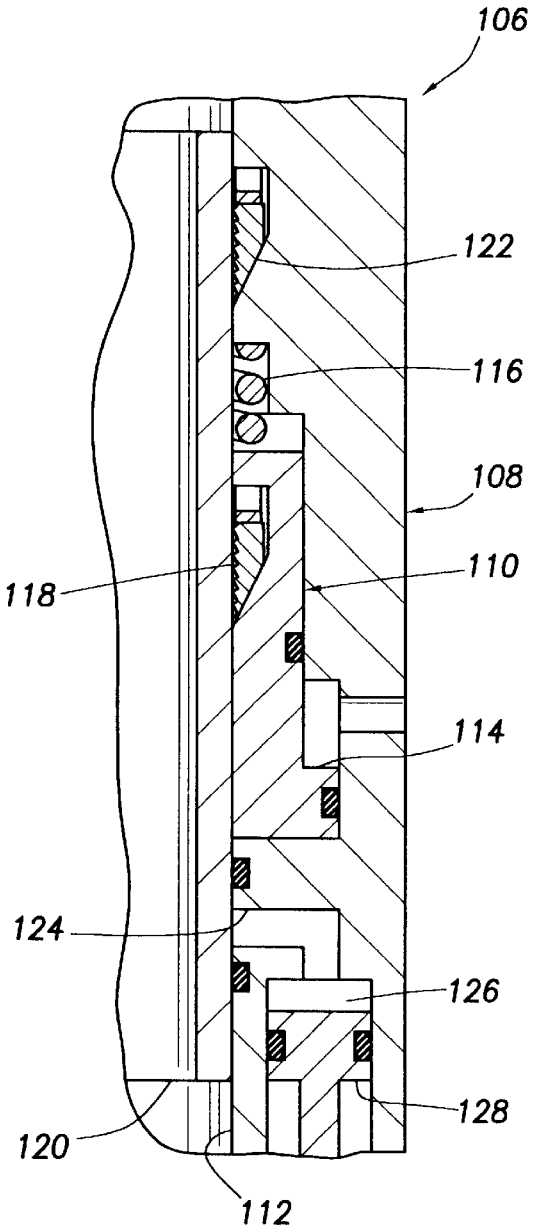
FIG. 5 is a schematic cross-sectional view of a portion of a third packer embodying principles of the present invention illustrating a method of arming and actuating same.

Referring additionally now to FIG. 5, another method 106 of arming and setting a packer 108 embodying principles of the present invention is schematically and representatively illustrated. The method 106 utilizes a mechanism 110 similar in many respects to a mechanism described in U.S. patent application Ser. No. 08/667,306, filed Jun. 20, 1996, and entitled Bidirectional Disappearing Plug, the disclosure of which is incorporated herein by this reference.

Fluid pressure applied to an internal flow passage 112 of the packer 108, which is greater than fluid pressure external to the packer, creates a pressure differential across a piston 114 of the mechanism 110. When the pressure differential is sufficiently great, the piston 114 displaces upwardly against a downwardly biasing force exerted by a spring 116. An internal slip 118 grips an inner sleeve 120 when the piston 114 displaces upwardly, causing the sleeve 120 to displace upwardly along with the piston.

When the pressure differential is released, or at least decreased sufficiently, the spring 116 displaces the piston 114 downwardly. The slip 118 does not grip the sleeve 120 sufficiently to cause the sleeve to displace downwardly with the piston, and another internal slip 122 prevents such downward displacement of the sleeve. Thus, with each cycle of applied and then released differential pressure across the piston 114, the sleeve 120 is made to incrementally displace upwardly.

When the sleeve 120 has been displaced upwardly a predetermined distance, due to a corresponding predetermined number of pressure differential applications, an internal fluid passage 124 is uncovered by the sleeve. At this point, fluid communication is permitted between the flow passage 112 and the fluid passage 124, and the packer 108 is armed. Fluid pressure in the flow passage 112 may now be applied to an internal chamber 126, in order to displace a piston 128 therein and set the packer 108.

Figure 6:
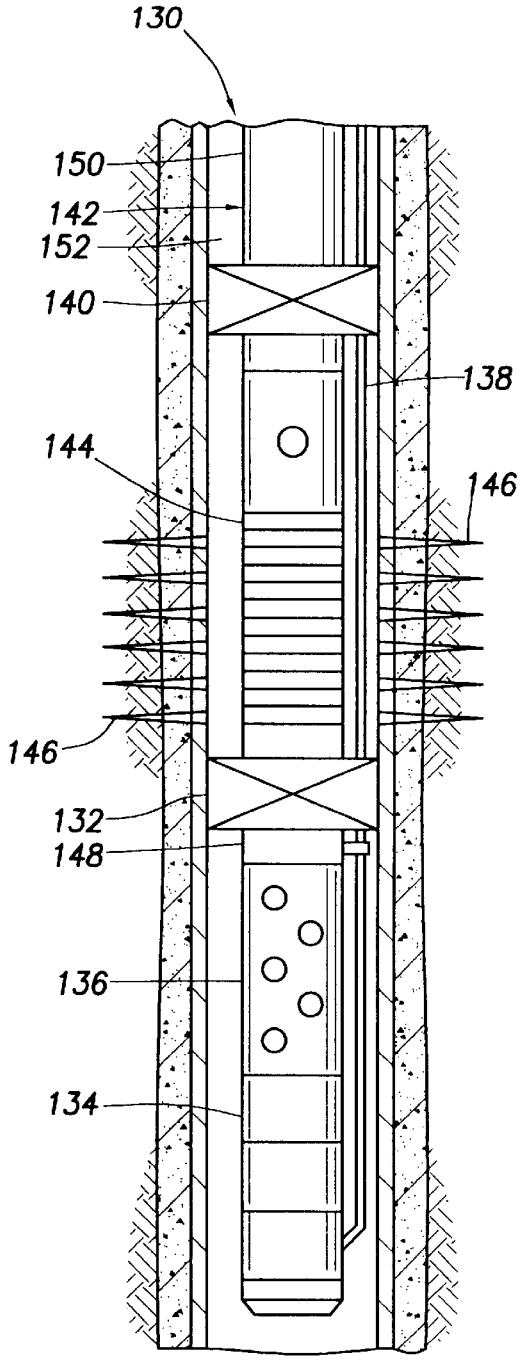
FIG. 6 is a schematic view of a second well completion method and system embodying principles of the present invention.

Referring additionally now to FIG. 6, another method 130 of arming and setting a packer 132 embodying principles of the present invention is schematically and representatively illustrated. The method 130 utilizes portions of a Select Fire perforating system available from Halliburton Energy Services, Inc. and well known to those skilled in the art. Elements of the Select Fire system are described in U.S. Pat. Nos. 5,287,924 and 5,355,957, the disclosures of which are incorporated herein by this reference.

In the method 130, fluid pressure is delivered to actuate a firing head 134 to fire a perforating gun 136 via a fluid conduit 138. As shown in FIG. 6, the fluid conduit 138 extends upwardly through the packer 132, and upwardly through an upper packer 140. The packers 132, 140, perforating gun 136 and firing head 134 are elements of a completion assembly 142, which also includes a well screen 144 disposed between the packers, and which is similar in most respects to the completion assembly 12 described above.

Note that it is not necessary for the fluid conduit 138 to extend through the packers 132, 140 as shown in FIG. 6, since other means and methods of delivering fluid pressure via the fluid conduit to the firing head 134 may be utilized without departing from the principles of the present invention.

In the method 130, fluid pressure is applied to the fluid conduit 138 to actuate the firing head 134 and fire the perforating gun 136. As shown in FIG. 6, the gun 136 has been fired, thereby forming perforations 146. The completion assembly 142 has then been lowered in the well, so that the screen 144 is positioned opposite the perforations.

The packer 132 is armed when the perforating gun 136 is fired. This is accomplished utilizing a Select Fire sub 148 as described in the incorporated U.S. Pat. Nos. 5,287,924 and 5,355,957. The Select Fire sub 148 permits fluid communication between the fluid conduit 138 and an internal chamber (not shown in FIG. 6) of the packer 132 in response to firing of the gun 136. Now fluid pressure applied to the fluid conduit 138 will cause the packer 132 to set in the well. The upper packer 140 may also be placed in fluid communication with the fluid conduit 138 in response to the gun 136 firing, so that it may be armed and set simultaneously with the lower packer 132, or the upper packer may be separately armed and set. Note that fluid pressure may be applied to the fluid conduit 138 via the interior of a tubular string 150 or via an annulus 152 between the tubular string and the wellbore.

Figure 7B:
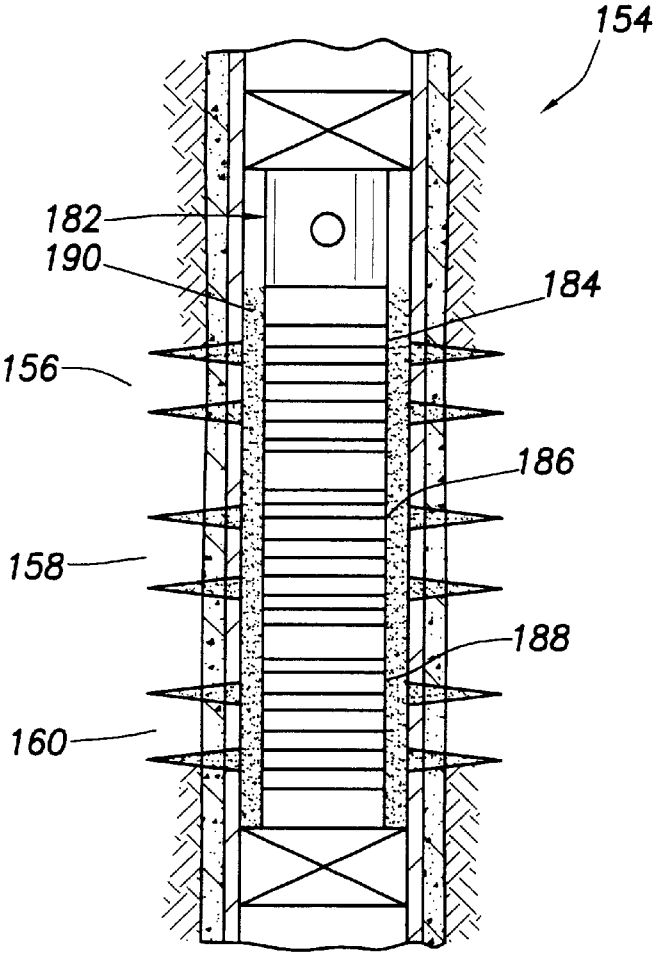
FIGS. 7A & 7B are schematic views of a third well completion method and system embodying principles of the present invention.
Figure 7A:
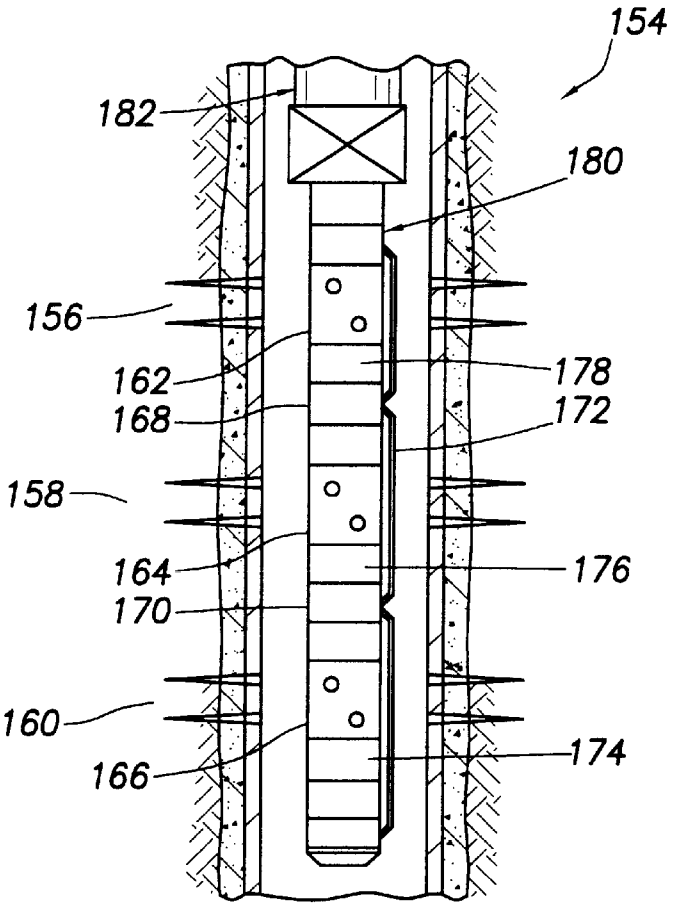

Referring additionally now to FIGS. 7A & 7B, another method 154 of completing a well embodying principles of the present invention is schematically and representatively illustrated. The method 154 utilizes elements of the Select Fire perforating system to sequentially perforate multiple zones 156, 158, 160. As shown in FIG. 7A, each of multiple perforating guns 162, 164, 166 is positioned opposite one of the zones 156, 158, 160 and fired. For example, the lower gun 166 may first be fired to perforate the zone 160, then gun 164 may be fired to perforate the zone 158, and then the upper gun 162 may be fired to perforate the zone 156. Such sequential firing of the guns 162, 164, 166 is permitted by utilizing Select Fire subs 168, 170.

A fluid conduit 172 interconnects the Select Fire subs 168, 170 and fluid pressure therein is used to actuate a firing head 174 attached to the lower perforating gun 166. When the lower perforating gun 166 has been fired, the middle perforating gun 164 is armed and fluid pressure in the fluid conduit 172 is used to actuate a firing head 176 to fire the middle perforating gun. When the middle perforating gun 164 has been fired, the upper perforating gun 162 is armed and fluid pressure in the fluid conduit 172 is used to actuate a firing head 178 to fire the upper perforating gun.

The perforating guns 162, 164, 166, firing heads 174, 176, 178, and the Select Fire subs 168, 170 are included in a perforating assembly 180 attached below a well treatment assembly 182, similar to the manner utilized in the method 10 described above. Sequential firing of the guns 162, 164, 166 as described above permits separate testing of the zones 156, 158, 160 prior to the well treatment operations, and permits widely or closely spaced zones to be completed in a single trip into the well.

In FIG. 7B, it may be seen that the well treatment assembly 182 has been positioned opposite the perforated zones 156, 158, 160, and the perforating assembly 180 has been retrieved from the well by displacing it upwardly through a portion of the well treatment assembly, in a manner similar to that used in the method 10 described above. Each of three screens 184, 186, 188 is now positioned opposite one of the perforated zones 156, 158, 160 and gravel 190 surrounds the screens in the wellbore. Thus, the method 154 permits convenient completion of multiple zones in a single trip into the well, without requiring perforating guns to be dropped off, or otherwise left in the well. Of course, other numbers of zones may be completed, and other means of firing perforating guns may be utilized in a method of completing multiple zones incorporating principles of the present invention.

Referring additionally now to FIGS. 8A–8D, another method 192 of completing a well embodying principles of the present invention is schematically and representatively illustrated. The method 192 uses a perforating assembly 194which is similar in many respects to the perforating assembly 180 described above. The perforating assembly 194 includes multiple perforating guns 196, 198, 200, multiple Select Fire subs 202, 204 and a fluid conduit 206 to perforate a single zone 208 intersected by the well.

Where a perforating assembly is to be retrieved from a well by displacing it through an item of equipment, such as a screen, a desired perforating performance may not be available in a perforating gun which fits through an inner passage of the screen. For example, in some circumstances, a desired shot density may not be available in a perforating gun which fits through a selected screen inner passage. The method 192 provides one manner of solving this problem, where an increased shot density is desired to increase perforating performance.

Figure 8B:
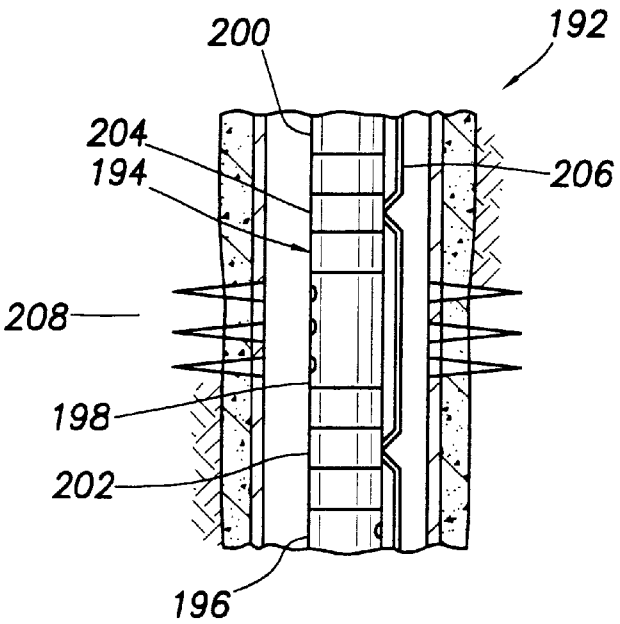
FIGS. 8A–8D are schematic views of a fourth well completion method and system embodying principles of the present invention.
Figure 8A:
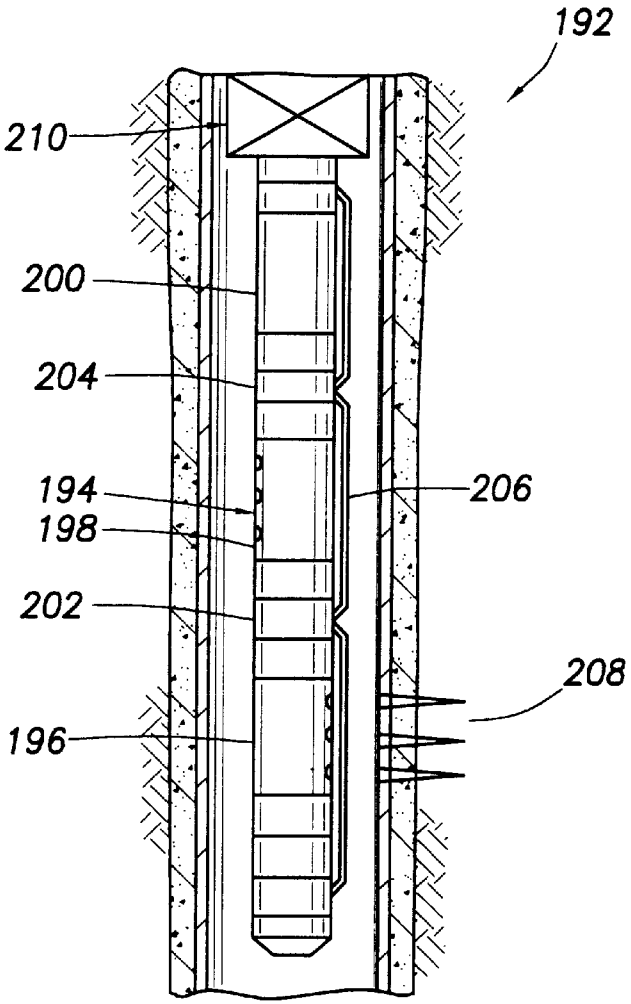
Figure 8D:
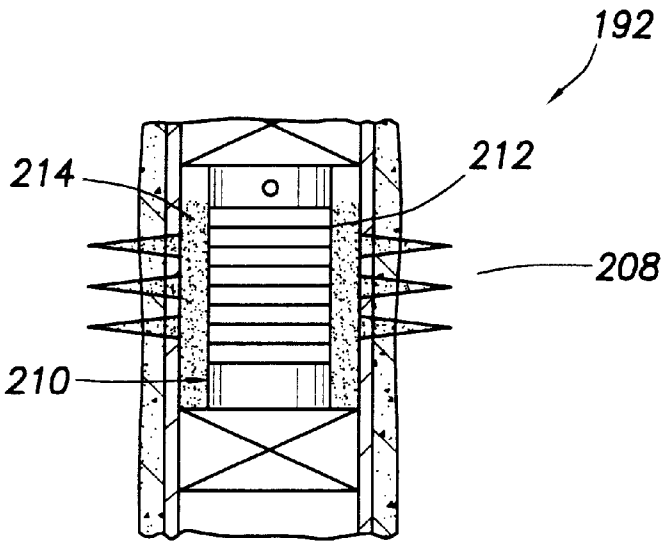
Figure 8C:
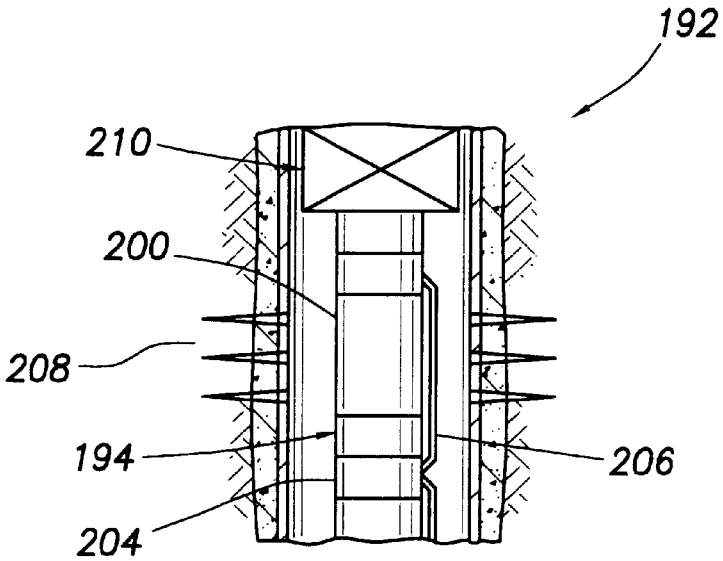

In the method 192, each of the perforating guns 196, 198, 200 is fired into the same zone 208, thus increasing the effective shot density. In FIG. 8A, the lower perforating gun 196 has been positioned opposite the zone 208 and fired to perforate the zone. In FIG. 8B, the perforating assembly 194 has been lowered in the well to position the middle gun 198 opposite the zone 208, and the gun has been fired to again perforate the zone. In FIG. 8C, the perforating assembly 194 has again been lowered in the well to position the upper gun 200 opposite the zone 208. The gun 200 has been fired (the resulting perforations not being visible in FIG. 8C, since they extend into the drawing sheet to the other side of the gun) to perforate the zone yet again.

These steps of repositioning the perforating assembly 194 and sequentially perforating the same zone multiple times may be repeated as desired, with any number of perforating guns, until a desired shot density is achieved. After the perforating operation, a well treatment assembly 210 is positioned opposite the perforated zone 208. The zone 208 is then completed as described above for the method 10. As shown in FIG. 8D, a screen 212 of the well treatment assembly 210 is positioned opposite the perforated zone 208 and gravel 214 surrounds the screen in the wellbore. The perforating assembly 194 is retrieved from the well by displacing it upwardly through the remaining portion of the well treatment assembly 210. Thus, it may be seen that the method 192 permits a zone 208 to be perforated multiple times using sequentially fired perforating guns 196, 198, 200, and the zone treated, in a single trip into the well, without requiring that any of the guns be dropped off or otherwise left in the well.

Figure 9:
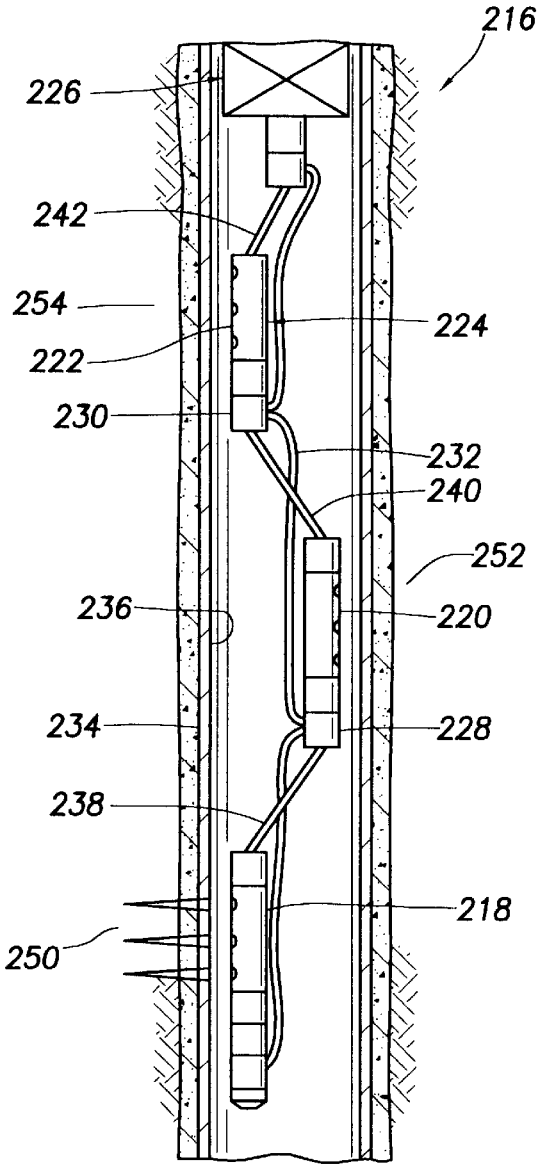
FIG. 9 is a schematic view of a fifth well completion method and system embodying principles of the present invention.

Referring additionally now to FIG. 9, another method 216 of completing a subterranean well embodying principles of the present invention is schematically and representatively illustrated. The method 216 is similar in many respects to the method 154 described above, in that multiple perforating guns 218, 220, 222 are utilized in a perforating assembly 224 suspended below a well treatment assembly 226. The perforating guns 218, 220, 222 may be sequentially fired using the Select Fire system, e.g., Select Fire subs 228, 230 and fluid conduit 232, however, such sequential firing of the perforating guns is not necessary in the method 216, since the guns could be fired simultaneously if desired.

The method 216 enhances perforating performance by positioning the perforating guns 218, 220, 222 in close proximity to or adjacent the casing 234 or wall of the wellbore 236. It will be readily appreciated by one skilled in the art that measures of perforating performance, such as depth of penetration, hole size, etc., are generally increased when a perforating gun is in close proximity to its target.

As depicted in FIG. 9, the perforating guns 218, 220, 222 are placed in close proximity to the casing 234 by use of multiple offsetting devices 238, 240, 242. Each offsetting device 238, 240, 242 laterally offsets one or more perforating gun in the wellbore 236, and in particular, the offsetting devices laterally offset the perforating guns 218, 220, 222 relative to the well treatment assembly 226.

Figure 10:
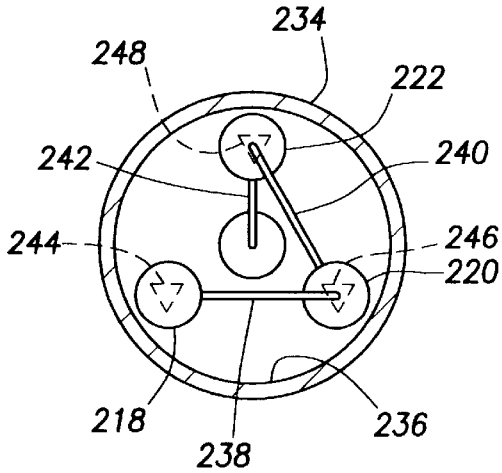
FIG. 10 is a schematic view of an alternate configuration of perforating guns in the fifth well completion method and system.

Note that in FIG. 9, the perforating guns 218, 220, 222 are offset by the offsetting devices 238, 240, 242, so that the perforating guns alternate from side to side in the wellbore 236. Alternatively, the perforating guns 218, 220, 222 could be configured in a linear array, in which case the perforating guns would be disposed adjacent one side of the wellbore 236. As another alternative, FIG. 10 shows the perforating guns 218, 220, 222 from a bottom view thereof in the wellbore 236, in which the guns are configured in a helical array. In FIG. 10, the fluid conduit 232, and other portions of the perforating assembly 224 are not shown for illustrative clarity. Note that perforating charges 244, 246, 248, commonly referred to as shaped charges, are positioned within the respective guns 218, 220, 222, so that the charges face outwardly.

Each of the offsetting devices 238, 240, 242 is an elongated member capable of maintaining one or more perforating guns laterally offset in the well. The offsetting devices 238, 240, 242 may be conventional tools known as kickover tools, well known to those skilled in the art, or they may be other types of tools, some of which are described in more detail below.

When configured as shown in FIG. 9, the perforating guns 218, 220, 222 may be used to perforate multiple zones 250, 252, 254 as described above for the method 154, or the guns may be used to perforate a single zone as described above for the method 192. If the perforating assembly 224 is used to perforate a single zone, the configuration depicted in FIG. 10 may be preferred, since it distributes the perforations produced by the charges 244, 246, 248 substantially evenly into the zone perforated.

Note that it is not necessary in a method incorporating principles of the present invention for multiple independently or sequentially firable guns 218, 220, 222 to be used in the perforating assembly 224. Additionally, it is not necessary for the Select Fire system to be utilized in the method 216 at all.

After the zones 250, 252, 254, or a single zone, is/are perforated, the well treatment assembly 226 is repositioned in the well opposite the perforated zone(s), the zone(s) is/are treated, and the perforating assembly 224 is then displaced upwardly through a portion of the well treatment assembly and retrieved from the well as described above. In some circumstances, it may be necessary for the perforating guns 218, 220, 222 to be aligned with an inner passage of the well treatment assembly 226 in order for the perforating assembly 224 to be displaced therethrough. In that case, the offsetting devices 238, 240, 242 may permit the guns 218, 220, 222 to be laterally aligned with the inner passage of the well treatment assembly 226 in response to firing one or more of the guns, in response to displacing the perforating assembly 224 relative to the well treatment assembly 226, or in another manner. Examples of spacers and offsetting devices which are responsive to gun firing or displacement of a perforating assembly relative to a well treatment assembly are described in more detail below.

Figure 11B:
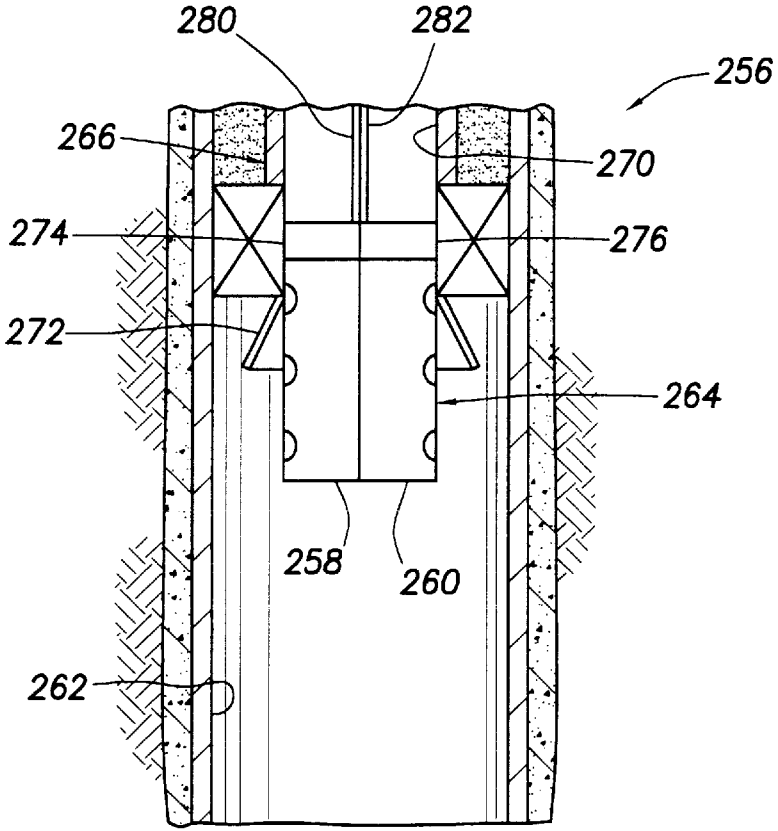
FIGS. 11A & 11B are schematic views of a sixth well completion method and system embodying principles of the present invention.
Figure 11A:
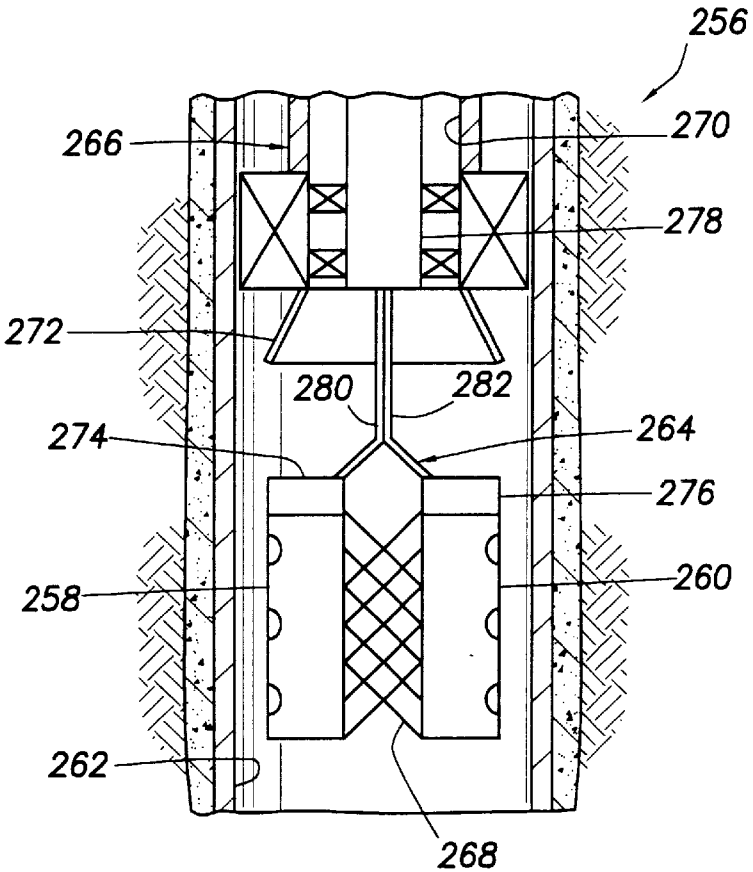

Referring additionally now to FIGS. 11A & 11B, another method 256 of completing a subterranean well embodying principles of the present invention is schematically and representatively illustrated. In the method 256, perforating performance is enhanced by laterally spacing apart perforating guns 258, 260 in a wellbore 262 as part of a perforating assembly 264 suspended below a well treatment assembly 266.

The perforating assembly 264 includes a spacer 268 for laterally spacing apart the guns 258, 260. The spacer 268 depicted in FIG. 11A is made of a mesh-type material, for example, a type of expanded metal, etc. Of course, other types of spacers and other spacer materials may be utilized in the method 256 without departing from the principles of the present invention.

In one embodiment of the method 256, the guns 258, 260 are configured and positioned so that perforating charges (not shown in FIG. 11A) therein face outwardly. It will be readily appreciated by one skilled in the art that, when the guns 258, 260 are fired, a reaction force will bias each gun inwardly as the perforating charges detonate. Applicants utilize this reaction force to collapse the spacer 268, so that the guns 258, 260 will fit through an inner passage 270 of the well treatment assembly 266 after the guns have fired. This permits retrieval of the guns 258, 260 after the well treatment operation. In FIG. 11B, the perforating assembly 264 is shown after the spacer 268 has collapsed, with the perforating assembly being displaced upwardly through the passage 270 for retrieval from the well.

Note that, before the guns 258, 260 are fired, the perforating assembly 264 has a size, its width, which prevents it from being displaced through the passage 270. However, after the guns 258, 260 have been fired, the perforating assembly 264 size is reduced, so that it now may be displaced through the passage 270. The decrease in the perforating assembly 264 width may be aided by an inverted conical shaped scoop 272 attached below, or as a part of, the well treatment assembly 266. Thus, as the perforating assembly 264 is displaced upwardly, the scoop 272 acts to laterally compress the guns 258, 260 to thereby reduce the width of the perforating assembly.

As described above, the spacer 268 collapses, or otherwise laterally compresses, when the guns 258, 260 are fired. However, such is not necessary in the method 256. Alternatively, the spacer 268 may be made to collapse, or otherwise laterally compress, when the perforating assembly 264 is displaced upwardly relative to the well treatment assembly 266. For example, the scoop 272 may exert an inwardly biasing force on each of the guns 258, 260, which force acts to compress the spacer 268, when the perforating assembly 264 is displaced upwardly and the guns engage the scoop.

Note that each perforating gun 258, 260 has a firing head 274, 276 attached thereto. Each firing head 274, 276 is in fluid communication with a washpipe 278 of the well treatment assembly 266 via a fluid conduit 280, 282. The fluid conduits 280, 282 also serve to suspend the remainder of the perforating assembly 264 below the well treatment assembly 266. The perforating guns 258 may be fired by applying fluid pressure to the conduits 280, 282, the fluid pressure actuating the firing heads 274, 276. However, it is to be clearly understood that the guns 258, 260 may be fired by any other method, without departing from the principles of the present invention. Additionally, it is not necessary in a method incorporating principles of the present invention for two guns to be utilized, for the scoop 272 to be configured as depicted in FIGS. 11A & 11B, for each gun to have a separate firing head, or for the guns to be spaced apart in the exact configuration shown, etc.

Figure 12A:
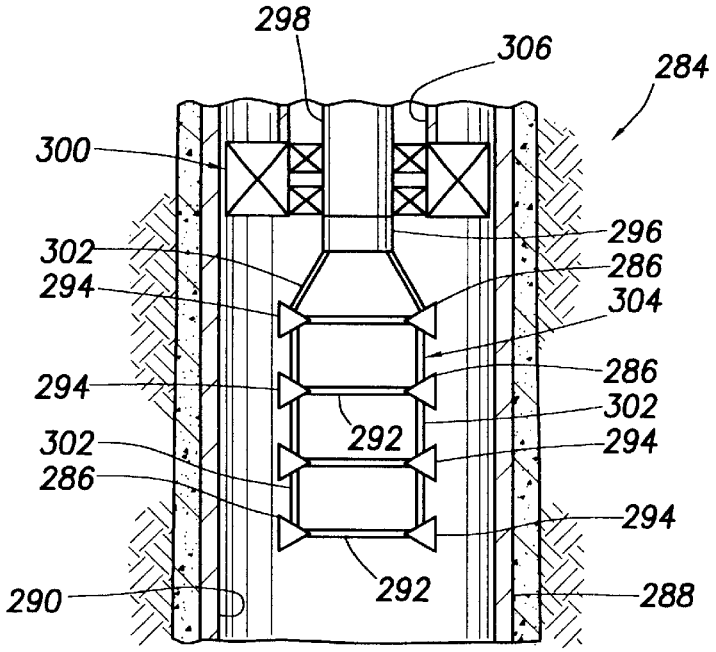
FIGS. 12A & 12B are schematic views of a seventh well completion method and system embodying principles of the present invention.
Figure 12B:
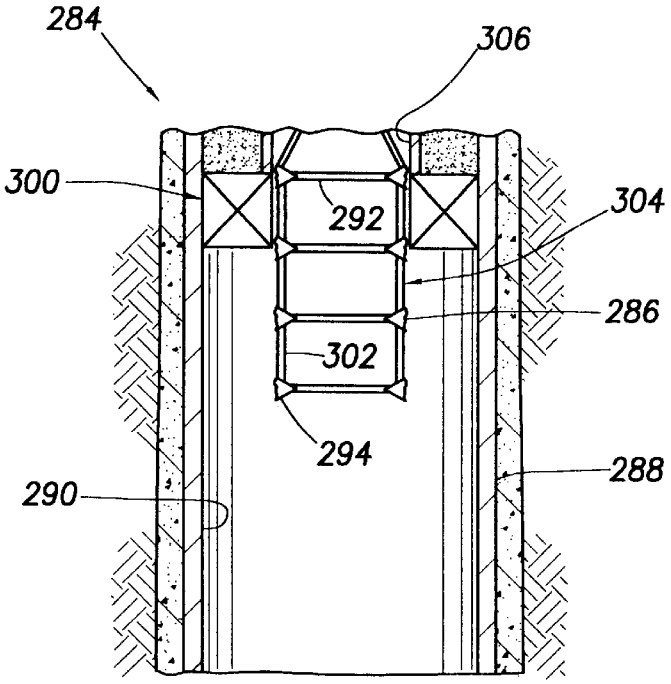

Referring additionally now to FIGS. 12A & 12B, another method 284 of completing a subterranean well embodying principles of the present invention is schematically and representatively illustrated. In the method 284, perforating performance is enhanced by laterally spacing apart individual perforating charges 286 in a two-dimensional array, so that the charges are positionable in close proximity to casing 288 lining the wellbore 290. The charges 286 are laterally spaced apart by elongated members or spacers 292.

Each perforating charge 286 has a pressure tight outer case 294. The charges 286 are detonated by actuating a firing head 296 attached to a washpipe 298 of a well treatment assembly 300. Conventional detonating cord (not visible in FIG. 12A) extends from the firing head 296 to each charge 286 via tubular members 302 extending downwardly from the firing head.

Note that, as depicted in FIG. 12A, and before the charges 286 have been detonated to perforate the well, the perforating assembly 304 has a size, its width, which prevents it from being displaced upwardly through an inner passage 306 of the well treatment assembly 300. However, after the charges 286 have been detonated, an outer portion of each charge outer case 294 is removed, thereby reducing the width of the perforating assembly 304 and permitting the perforating assembly to be displaced upwardly through the passage 306. FIG. 12B shows the perforating assembly 304 being displaced through the passage 306 after the charges 286 have been detonated, and after the well treatment operation.

Figure 13:
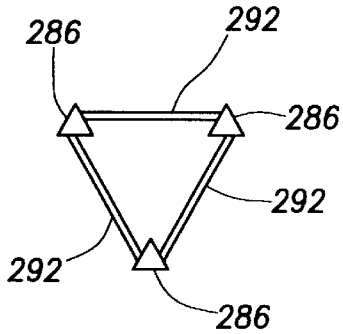
FIG. 13 is a schematic view of a first alternate perforating charge configuration in the seventh well completion method and system.
Figure 14:
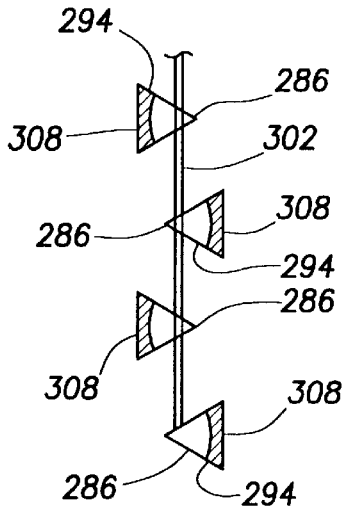
FIG. 14 is a schematic view of a second alternate perforating charge configuration in the seventh well completion method and system.

Although the perforating assembly 304 is depicted in FIGS. 12A & 12B as having a two-dimensional array of perforating charges 286, other configurations of charges may be utilized if desired. For example, FIG. 13 shows a three dimensional array of the charges 286 laterally separated by the spacers 292, from a bottom view thereof. The array of the charges 286, thus, has a triangular cross-section. As another example of an alternate configuration of the charges 286, FIG. 14 shows a one-dimensional or linear array of the charges, in which no lateral separation between the charges is used, although some lateral offset is present between adjacent ones of the charges. In FIG. 14, the outer portion 308 of the case 294 of each charge 286 which is removed when the charge is detonated is shaded, so that it may be clearly seen that the width of the perforating assembly is reduced when the charges are detonated.

Figure 15B:
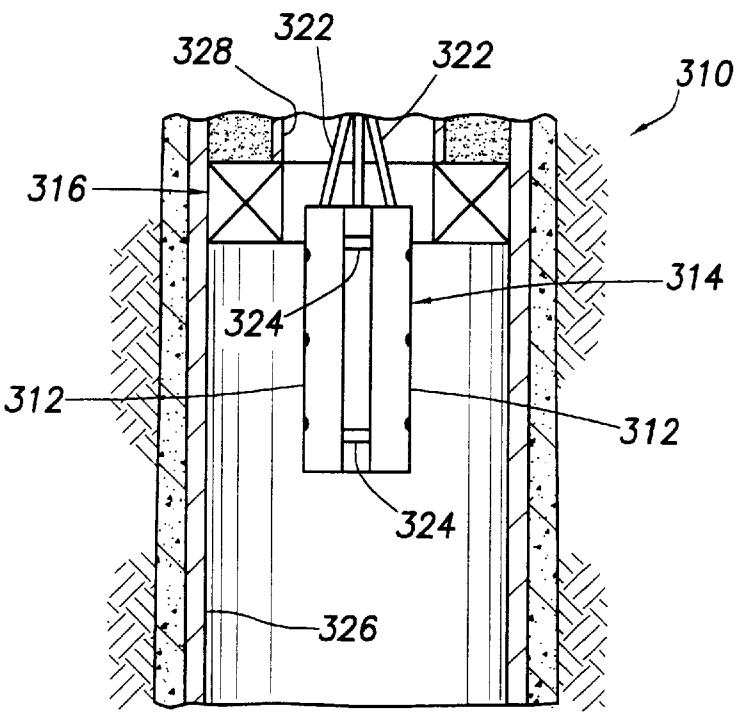
FIGS. 15A & 15B are schematic views of an eighth well completion method and system embodying principles of the present invention.
Figure 15A:
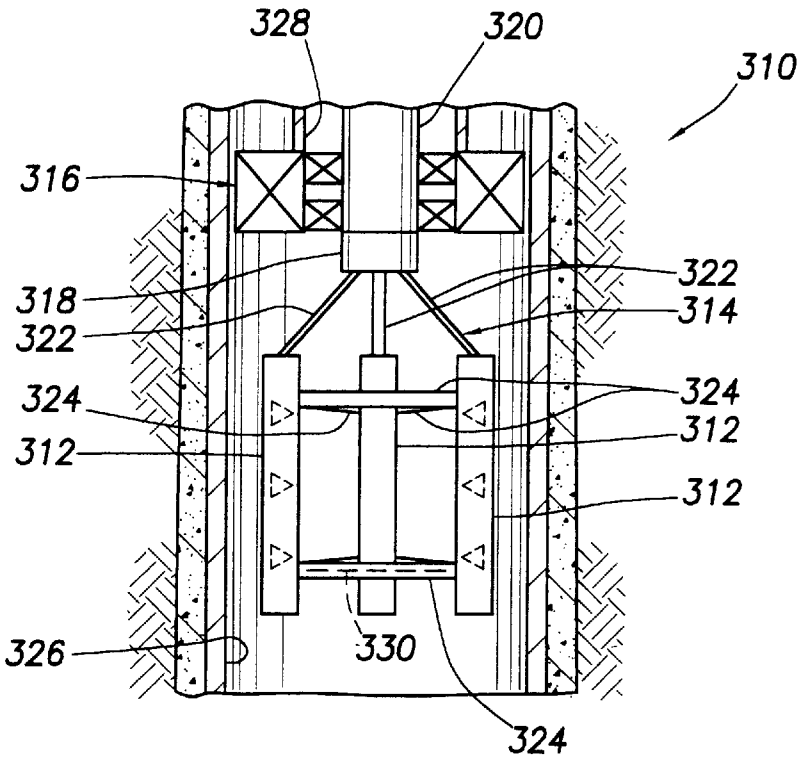

Referring additionally now to FIGS. 15A & 15B, another method 310 of completing a subterranean well embodying principles of the present invention is schematically and representatively illustrated. In the method 310, perforating performance is enhanced by laterally separating multiple perforating guns 312 as part of a perforating assembly 314 attached below a well treatment assembly 316. The guns 312 are fired by actuating a firing head 318 attached to a washpipe 320 of the well treatment assembly 316, the firing head being interconnected to each gun via members 322 extending between the firing head and each gun.

The guns 312 are laterally separated by elongated members or spacers 324, so that the guns form a three-dimensional array in the wellbore 326. As initially installed in the wellbore 326, the perforating assembly 314 has a size, its width, which prevents it from being displaced through an inner passage 328 of the well treatment assembly 316. However, after the guns 312 are fired, the size of the perforating assembly 314 is reduced, so that the perforating assembly may now be displaced through the passage 328, as shown in FIG. 15B.

To reduce the size of the perforating assembly 314, the spacers 324 may be displaced, reconfigured, broken, etc., in a variety of ways. It is to be clearly understood that the principles of the present invention may be incorporated in a method of completing a well, no matter the manner in which the perforating assembly 314 size is reduced to permit the perforating assembly to displace through the passage 328. For example, the spacers 324 may be broken, fractured, etc., by an explosive device, such as detonating cord 330 extending therein, which is detonated when the guns 312 are fired. The spacers 324 may be collapsed or folded due to the inwardly biasing reaction force which occurs when the guns 312 are fired, as described above for the method 256. The spacers 324 may permit inward displacement of the guns 312 when the perforating assembly 314 is displaced upwardly relative to the well treatment assembly 316. The spacers 324 may be permitted to displace into the guns 312 when the guns are fired. These and many other ways of breaking, shortening, folding, or otherwise reconfiguring or eliminating, etc., the spacers 324, or otherwise decreasing the lateral separation between the guns 312, may be utilized in the method 310, without departing from the principles of the present invention.

Figure 16A:
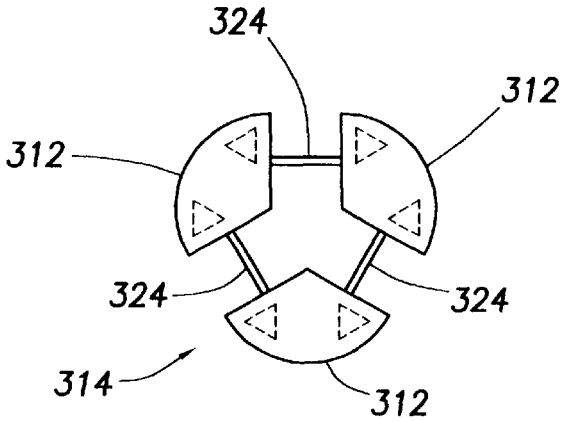
FIGS. 16A & 16B are schematic views of a first alternate perforating gun configuration in the eighth well completion method and system.
Figure 16B:
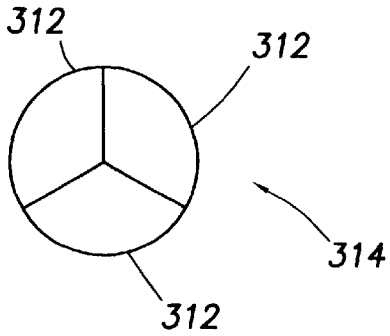
Figure 17A:
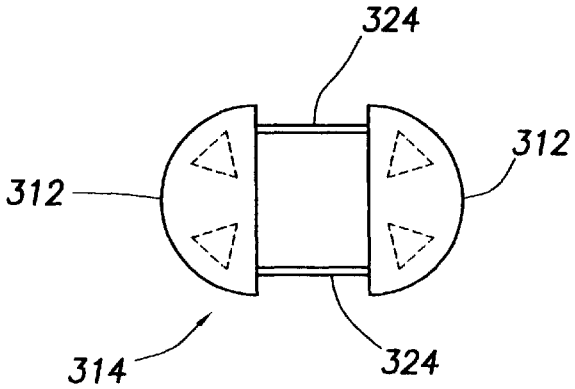
FIGS. 17A & 17B are schematic views of a second alternate perforating gun configuration in the eighth well completion method and system.
Figure 17B:
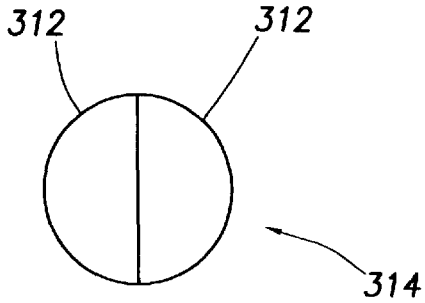

FIGS. 16A & 16B and FIGS. 17A & 17B show alternate configurations of the guns 312 in the method 310, from bottom views thereof. In FIG. 16A, three guns 312 are laterally separated by the spacers 324. The guns 312 are complementarily shaped with respect to each other, so that, when the size of the perforating assembly 314 is reduced as described above, the guns fit together in a compact configuration as shown in FIG. 16B. In FIG. 17A, two guns 312 are similarly separated by the spacers 324. These guns 312 are differently shaped as compared to the guns shown in FIGS. 16A & 16B, but are nevertheless complementarily shaped with respect to each other. In FIG. 17B, the perforating assembly 314 is shown in its reduced size configuration, with the guns 312 fitting together compactly. It will be readily appreciated that such complementarily shaped guns 312 enhance the ability of the perforating assembly 314 to be displaced through the passage 328 of the well treatment assembly 316 while retaining the perforating performance achieved by initially laterally spacing apart the guns.

Figure 18B:
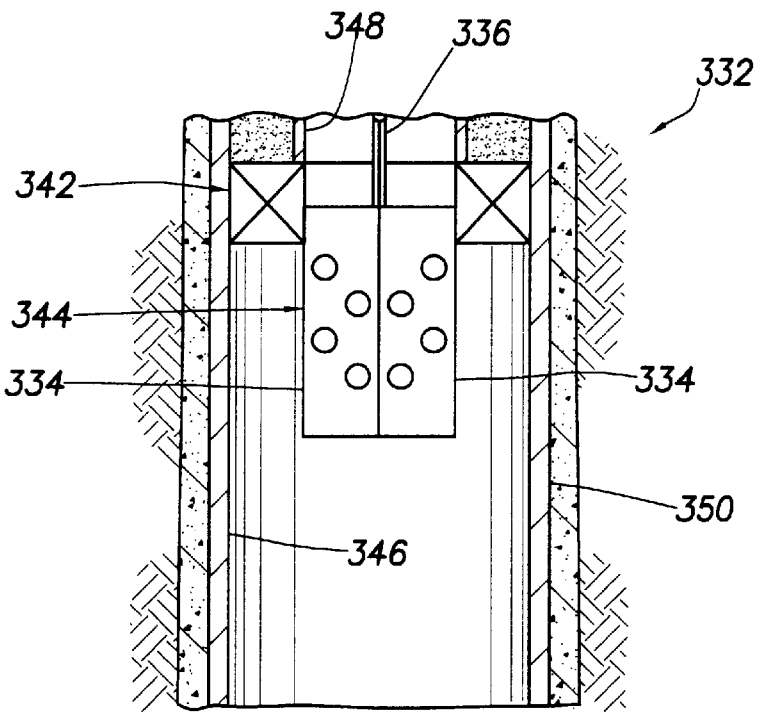
FIGS. 18A & 18B are schematic views of a ninth well completion method and system embodying principles of the present invention.
Figure 18A:
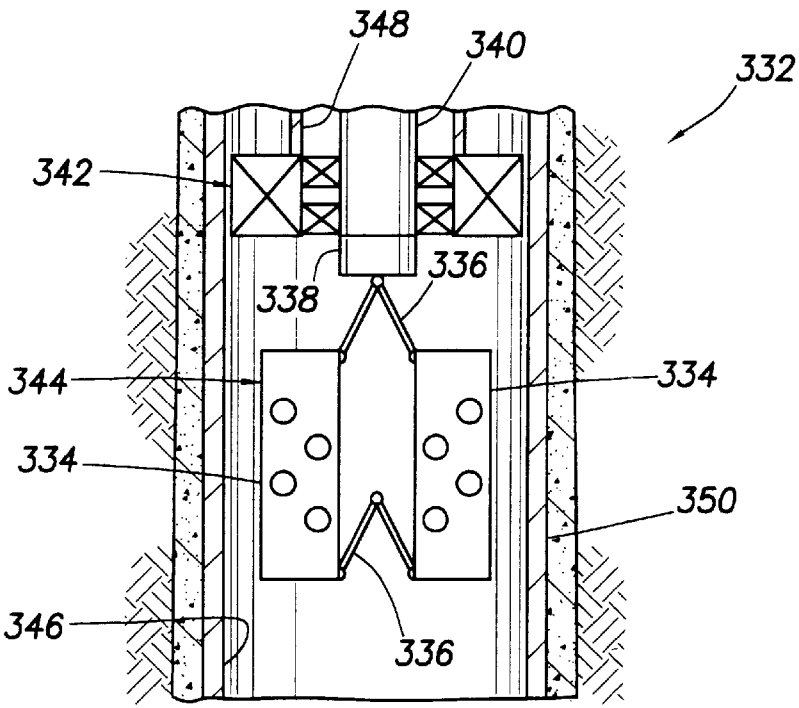

Referring additionally now to FIGS. 18A & 18B, another method 332 of completing a subterranean well is schematically and representatively illustrated. In the method 332, a perforating assembly 344 includes perforating guns 334 initially laterally spaced apart by spacers which are articulated linkages 336. An upper one of the linkages 336 interconnects the guns 334 to a firing head 338 attached to a washpipe 340 of a well treatment assembly 342. The upper linkage may, for example, be at least partially hollow, so that a detonating cord may extend from the firing head 338 to each of the guns 334 through the upper linkage 336.

As depicted in FIG. 18A, when initially installed in a wellbore 346 of the well, the perforating assembly 344 has a size which prevents it from being displaced through an inner passage 348 of the well treatment assembly 342. The initial lateral separation of the guns 334 enhances perforating performance by positioning each of the guns in close proximity to casing 350 lining the wellbore 346. After the guns 334 are fired, however, the size of the perforating assembly 344 is reduced, so that the guns 334 may now be displaced through the passage 348 as shown in FIG. 18B. In the method 332, the perforating assembly 344 is displaced upwardly through the passage 348 for retrieval from the well after the guns 334 have been fired, the well treatment assembly 342 has been repositioned opposite the perforated portion of the well, and the well treatment operation has been performed.

To reduce the size of the perforating assembly 344, the linkages 336 are folded or otherwise operated to reduce the lateral separation between the guns 334. Such operation of the linkages 336 may be performed in response to firing of the guns 334, in response to displacement of the perforating assembly 344 relative to the well treatment assembly 342, or in response to any other operation.

Figure 19:
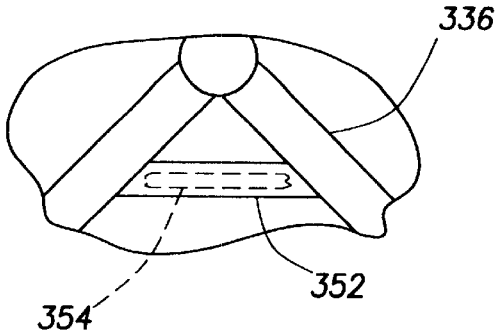
FIG. 19 is an enlarged scale schematic view of a first alternate configuration of an articulated linkage in the ninth well completion method and system.
Figure 20:
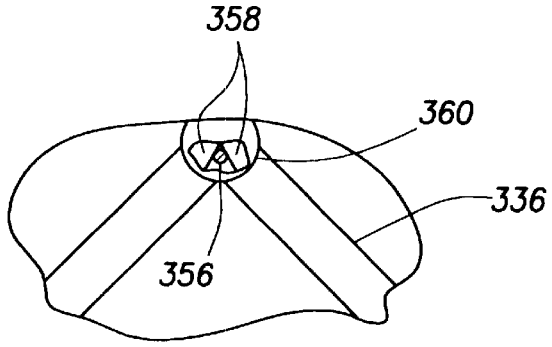
FIG. 20 is an enlarged scale schematic view of a second alternate configuration of an articulated linkage in the ninth well completion method and system.
Figure 21:
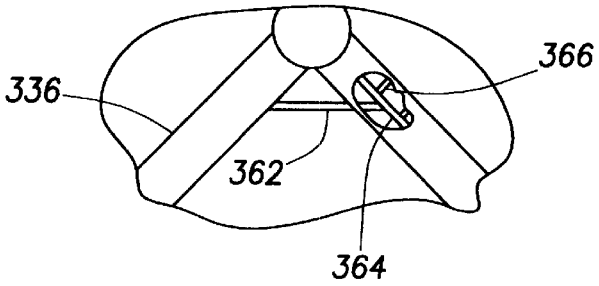
FIG. 21 is an enlarged scale schematic view of a third alternate configuration of an articulated linkage in the ninth well completion method and system.

In FIGS. 19, 20 & 21, various alternate manners of operating the linkages 336 in response to firing of the guns 334 in the method 332 are schematically and representatively illustrated. However, it is to be clearly understood that any manner of operating the linkages, whether or not in response to firing of the guns 334, may be utilized in the method 332 without departing from the principles of the present invention.

In FIG. 19, the linkage 336 is maintained in a laterally extended configuration by a substantially hollow elongated member, spacer or prop 352. An explosive device or length of detonating cord 354 extends at least partially through the prop 352. When the guns 334 are fired, the cord 354 detonates, thereby breaking the prop 352 or at least displacing it from its position maintaining the linkage 336 in its laterally extended configuration. The linkage 336 may then laterally compress due to the weight of the guns 334, due to a force exerted by a biasing member (not shown), etc.

In FIG. 20, the linkage 336 is maintained in a laterally extended configuration by an explosive device or detonating cord 356 disposed between portions 358 of a pivotable joint 360 of the linkage 336. Thus, the detonating cord or other explosive device 356 itself props the linkage 336 open in its laterally extended configuration. When the guns 334 are fired, the explosive device detonates, thereby permitting the linkage to displace from its laterally extended configuration, and permitting the guns to displace inwardly due to their own weight and/or an applied force.

In FIG. 21, the linkage 336 is maintained in a laterally extended configuration by a spacer or prop 362, which in turn is prevented from displacing by an explosive device or detonating cord 364. The detonating cord 364 blocks the prop 362 from displacing through an opening 366 formed in the linkage 336. When the detonating cord 364 detonates, the prop 362 is permitted to displace through the opening 366, thereby permitting the linkage 336 to laterally compress. The detonating cord 364 may be detonated in response to firing of the guns 334.

Note that each of the manners of operating the linkage 336 described above and illustrated in FIGS. 19, 20 & 21 utilizes an explosive device which detonates upon firing the guns 334. It is to be clearly understood, however, that a variety of other manners of operating the linkages 336 may be used in the method 332, without departing from the principles of the present invention. For example, the linkages 336 may be operated in response to the reaction force produced when the guns 334 are fired, or the linkages may be operated in response to displacement of the perforating assembly 344 relative to the well treatment assembly 342, etc. Additionally, the manners of operating the linkages 336 described above may be utilized in other methods described herein. For example, the offsetting devices 238, 240, 242 in the method 216 may be made to pivot and laterally align the guns 218, 220, 222 with the well treatment assembly 226 after the guns are fired using these manners of operating the linkages 336.

Figure 22B:
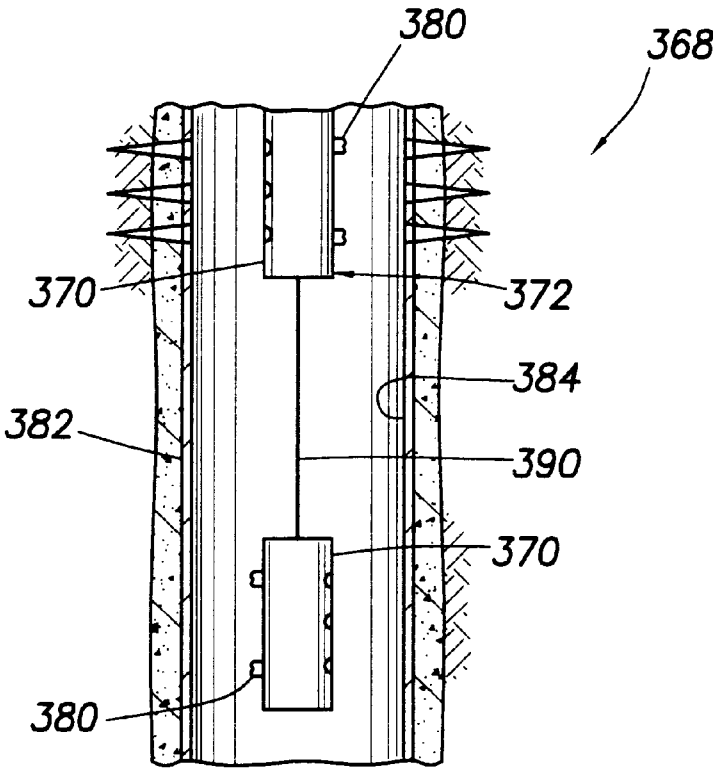
FIGS. 22A & 22B are schematic views of a tenth well completion method and system embodying principles of the present invention.
Figure 22A:
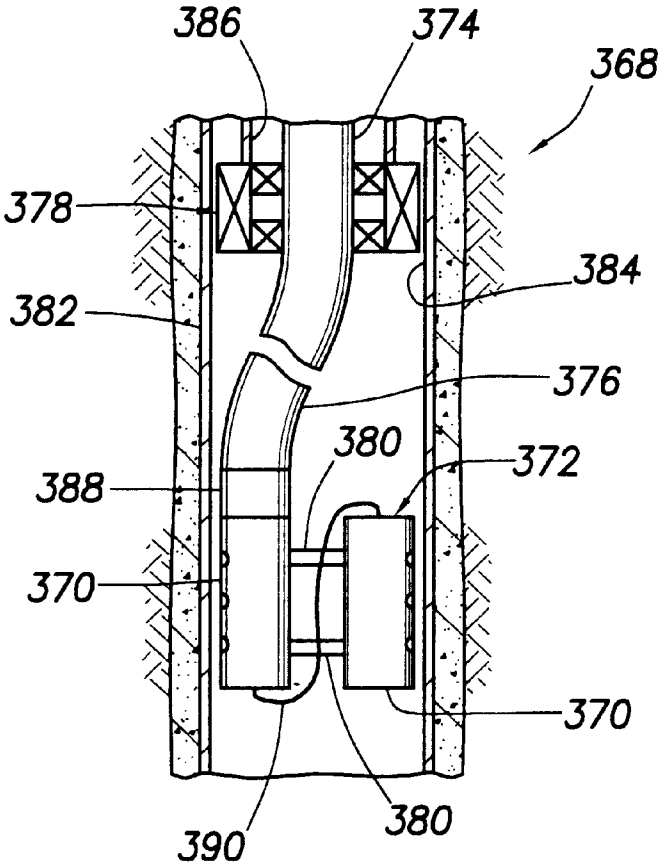

Referring additionally now to FIGS. 22A & 22B, another method 368 of completing a well embodying principles of the present invention is schematically and representatively illustrated. In the method 368, perforating guns 370 of a perforating assembly 372 are suspended from a tubular extension 376 of a washpipe 374. The washpipe 374 is part of a well treatment assembly 378 attached above the perforating assembly 372.

The guns 370 are initially laterally spaced apart by relatively rigid elongated members or spacers 380. Such lateral spacing apart of the guns 370 enhances perforating performance in the method 368 by positioning the guns in close proximity to casing 382 lining the wellbore 384 of the well. Note that, when initially installed in the well, the perforating assembly 372 has a size which prevents it from being displaced through an inner passage 386 of the well treatment assembly 378.

When the guns 370 are fired, the spacers 380 break, or otherwise cease to laterally space apart the guns, so that one of the guns is permitted to fall or otherwise displace downwardly relative to the other gun. The guns 370 may be fired by actuating a firing head 388 interconnected to one or more of the guns, and the spacers 380 may be broken by detonation of an explosive device therein as described above. However, it is to be clearly understood that other means and methods of disconnecting the spacers 380 between the guns 370, or of otherwise ceasing to laterally space apart the guns, may be utilized in the method 368 without departing from the principles of the present invention. Additionally, the step of ceasing to laterally space apart the guns 370 may be performed in response to firing of the guns, in response to displacing the perforating assembly 372 relative to the well treatment assembly 378, or in response to any other stimulus, without departing from the principles of the present invention.

A relatively flexible member or cable 390 interconnects the guns 370. When the spacers 380 cease to laterally space apart the guns 370, the cable 390 maintains an attachment between the guns, so that all of the guns may be retrieved together from the well with the remainder of the perforating assembly 372. As depicted in FIG. 22B, the guns 370 are longitudinally spaced apart after the spacers 380 cease to laterally space apart the guns. Thus, the guns 370 become laterally aligned with the well treatment assembly 378 and are permitted to fit through the passage 386 of the well treatment assembly after the well treatment operation.

Figure 23B:
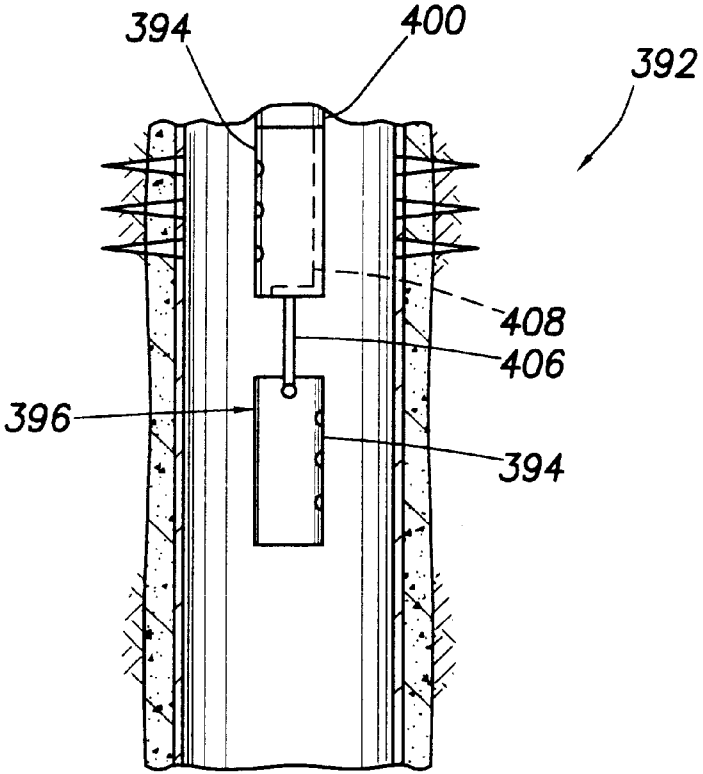
FIGS. 23A & 23B are schematic views of an eleventh well completion method and system embodying principles of the present invention.
Figure 23A:
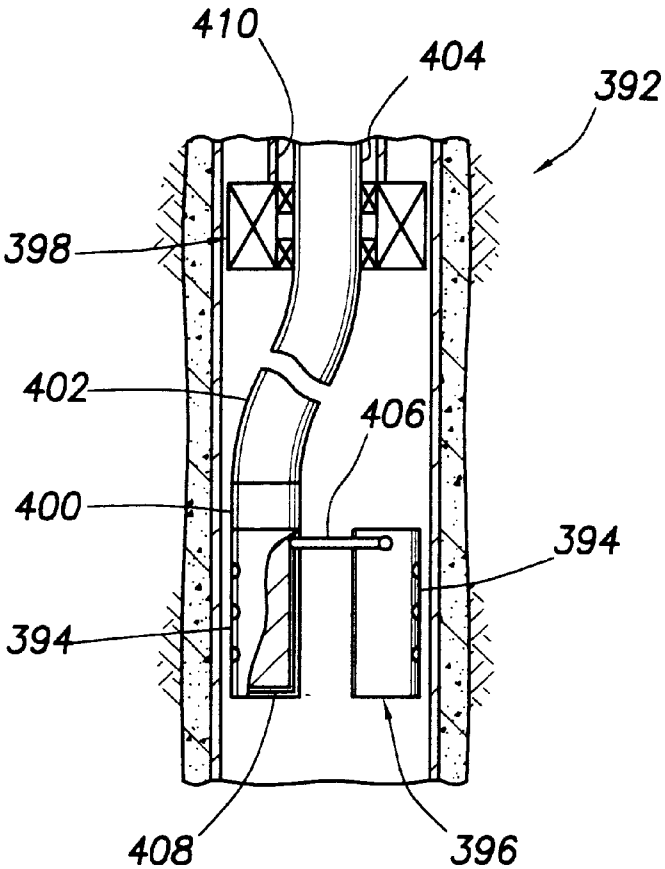

Referring additionally now to FIGS. 23A & 23B, another method 392 of completing a well embodying principles of the present invention is schematically and representatively illustrated. The method 392 is similar in many respects to the method 368 described above, in that perforating guns 394 of a perforating assembly 396 attached below a well treatment assembly 398 are initially laterally spaced apart, and then are longitudinally spaced apart, or at least laterally aligned with the well treatment assembly. The perforating assembly 396 includes a firing head 400 interconnected to at least one of the guns 394 and to a tubular extension 402 of a washpipe 404 of the well treatment assembly 398.

The guns 394 are initially laterally spaced apart by a spacer or linkage 406. The linkage 406 is pivotably attached to one of the guns 394, and is engaged with a generally longitudinally extending guiding device or track 408 formed on or attached to the other gun. When the guns 394 are fired, the linkage 406 is permitted to pivot with respect to the guns, and is permitted to displace along the track 408. Such pivoting and displacement of the spacer or linkage 406 may be permitted in response to firing of the guns 394, in response to displacement of the perforating assembly 396 with respect to the well treatment assembly 398, or in response to any other stimulus, and using any of the means or methods described above. For example, a detonating cord (not shown) may extend through the linkage 406 so that, when the guns 394 are fired, the cord detonates and causes the pivotable attachment between the linkage and one of the guns to be permitted to pivot as described above and shown in FIGS. 19–21.

When initially installed, the perforating assembly 396 has a size which prevents its displacement through an inner passage 410 of the well treatment assembly 398. However, after the linkage 406 has permitted one of the guns 394 to displace to a position below the other gun as shown in FIG. 23B, the perforating assembly 396 size is reduced, so that now the perforating assembly is permitted to displace through the passage 410.

Figure 24A:
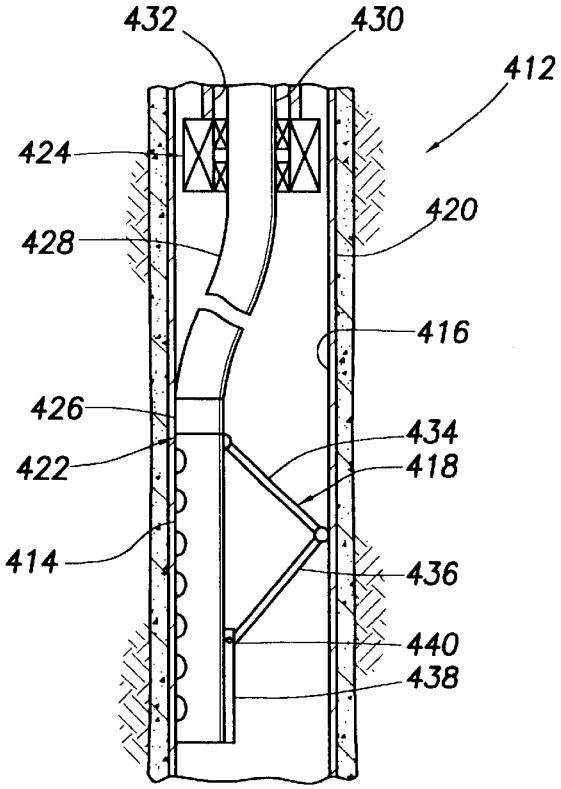
FIGS. 24A & 24B are schematic views of a twelfth well completion method and system embodying principles of the present invention.
Figure 24B:
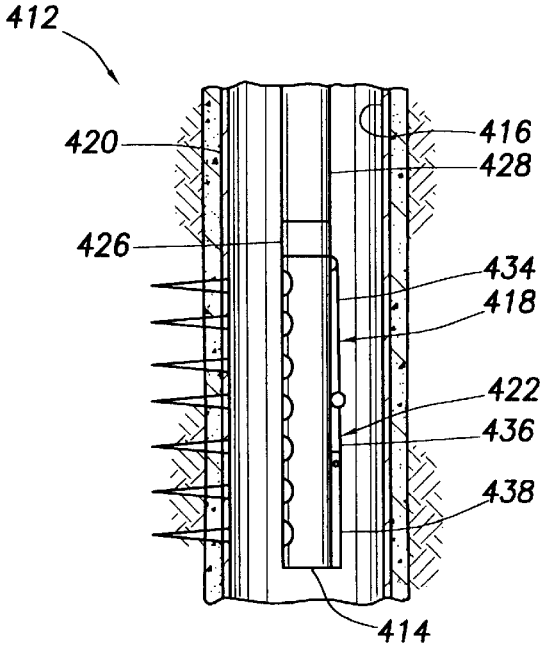

Referring additionally now to FIGS. 24A & 24B, another method 412 of completing a well embodying principles of the present invention is schematically and representatively illustrated. In the method 412, a perforating gun 414 is initially laterally offset within a wellbore 416 of the well by an offsetting device 418. The gun 414 and offsetting device 418 are parts of a perforating assembly 422 attached below a well treatment assembly 424. The offsetting device 418 maintains the gun 414 adjacent or in close proximity to casing 420 lining the wellbore 416, in order to enhance perforating performance. The gun 414 may be fired by actuating a firing head 426 attached between the gun and a tubular extension 428 of a washpipe 430 of the well treatment assembly 424.

Figure 25:
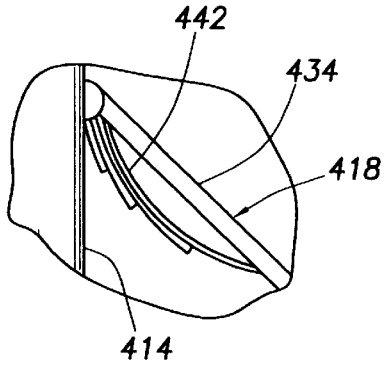
FIG. 25 is an enlarged scale schematic view of an alternate configuration of a linkage in the twelfth well completion method and system.

The perforating assembly 422 initially has a size which prevents it from displacing through an inner passage 432 of the well treatment assembly 424. However, when the gun 414 is fired, the offsetting device 418 laterally compresses, thereby permitting the perforating assembly 422 to be displaced through the passage 432. The offsetting device 418 may laterally compress in response to firing of the gun 414 in a variety of ways. For example, an upper arm 434 of the offsetting device 418 may be pivotably attached to the gun 414 in a manner such that pivoting displacement of the arm relative to the gun is prevented until the gun is fired, in a manner similar to that described above and illustrated in FIGS. 19–21. Alternatively, a lower arm 436 of the offsetting device 418 may be releasably retained against displacement relative to a guide device or track 438 formed on or attached to the gun 414. For example, a shear pin or other frangible member 440 may releasably retain the lower arm 436 relative to the track 438, until the gun 414 is fired and a reaction force produced thereby shears the pin. As another alternative, and as shown in FIG. 25, the offsetting device 418 may be biased to its laterally outwardly extended configuration by a bias member or spring 442, in which case the offsetting device may be laterally compressed by displacing the perforating assembly 422 upwardly relative to the well treatment assembly 424. When the upper arm 434 of the offsetting device 418 contacts the well treatment assembly 424, the spring 442 is compressed as the upper arm 434 is pivoted inwardly, thereby permitting the perforating assembly 422 to displace through the passage 432.

FIG. 24B shows the offsetting device 418 in a laterally compressed configuration after the gun 414 has been fired. Note that the offsetting device 418 no longer laterally offsets the gun 414, and the gun may be laterally aligned with the well treatment assembly 424. The perforating assembly 422 may now be displaced upwardly through the passage 432 and retrieved from the well after the well treatment operation.

Figure 26B:
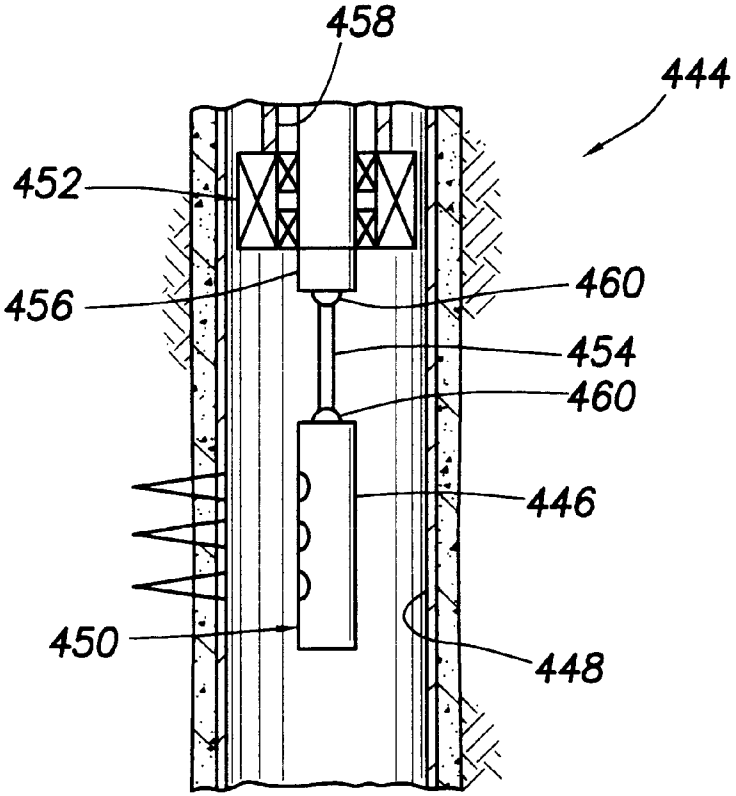
FIGS. 26A & 26B are schematic views of a thirteenth well completion method and system embodying principles of the present invention.
Figure 26A:
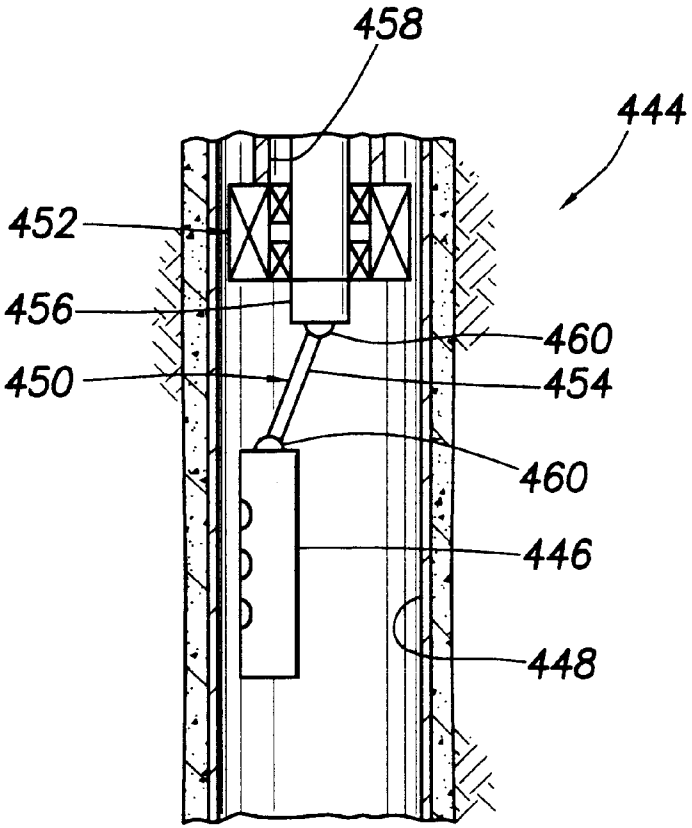

Referring additionally now to FIGS. 26A & 26B, another method 444 of completing a well embodying principles of the present invention is schematically and representatively illustrated. The method 444 is similar in many respects to other methods described above in that a perforating gun 446 is laterally offset within the wellbore 448 as a part of a perforating assembly 450 attached below a well treatment assembly 452. When initially installed, an offsetting device 454 pivotably attached between a firing head 456 and the gun 446 laterally offsets the gun relative to an inner passage 458 formed through the well treatment assembly 452 and prevents displacement of the perforating assembly 450 through the passage.

When the perforating gun 446 is fired, the offsetting device 454 is permitted to pivot at its attachments 460 to the firing head 456 and gun, and the gun is no longer maintained in a laterally offset position by the offsetting device. Such release for pivoting displacement at one or both of the pivotable attachments 460 of the offsetting device 454 may be accomplished in any manner, including those described above and illustrated in FIGS. 19–21. For example, an explosive device, such as detonating cord may extend through the offsetting device between the firing head 456 and the gun 446. When the gun 446 is fired, detonation of the detonating cord may cause one or both of the pivotable attachments of the offsetting device 454 to be released for pivoting displacement. Of course, other methods of releasing one or more of the pivotable attachments 460 may be utilized in the method 444 without departing from the principles of the present invention. For example, one or more of the attachments 460 may be released in response to displacement of the perforating assembly 450 relative to the well treatment assembly 452. Note that it is not necessary for both or all of the pivotable attachments 460 to be initially prevented from pivoting displacement, since only one is needed to be prevented from pivoting displacement in order to laterally offset the gun 446 in the well.

In FIG. 26B, the gun 446 has been fired and the offsetting device 454 no longer laterally offsets the gun in the well. The perforating assembly 450 may now be displaced through the passage 458 after the well treatment operation is completed as described above.

Figure 27A:
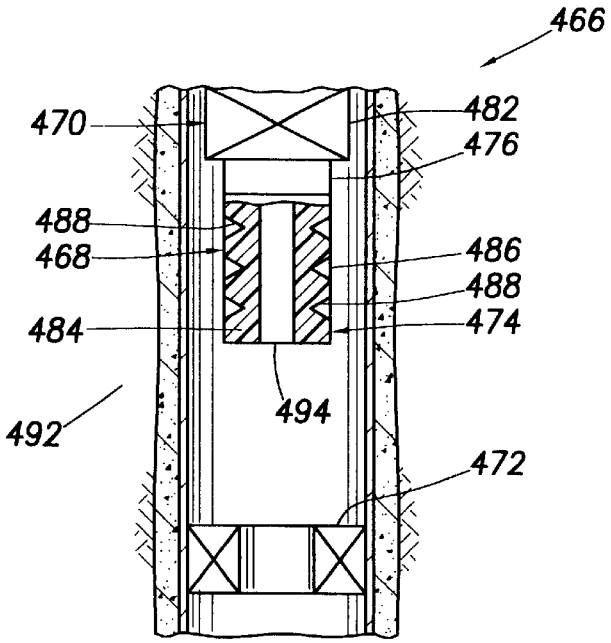
FIGS. 27A & 27B are schematic views of a fourteenth well completion method and system embodying principles of the present invention.
Figure 27B:
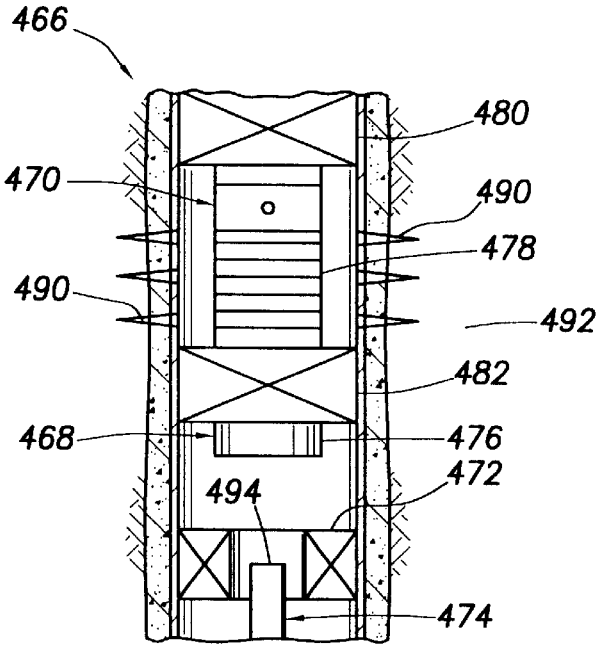

Referring additionally now to FIGS. 27A & 27B, another method 466 of completing a subterranean well embodying principles of the present invention is schematically and representatively illustrated. In the method 466, a perforating gun assembly 468 and a well treatment assembly 470 are conveyed into a well. The method 466 differs in at least one respect from the methods described above, however, in that it is desired to displace at least a portion of the perforating gun assembly 468 through a restriction, such as a packer 472, below the perforating gun assembly. It is to be clearly understood that the restriction 472 is not necessarily a packer, but could be another type of restriction or item of equipment, such as another well treatment assembly, a liner hanger, etc.

The perforating assembly 468 includes a perforating gun 474 and a firing head 476. The perforating assembly 468 is attached below the well treatment assembly 470, which includes a well screen 478 disposed between two packers 480, 482. Of course, other configurations of perforating assemblies and well treatment assemblies may be used in the method 466, without departing from the principles of the present invention.

The perforating gun 474 is prevented from displacing through the packer 472 when the perforating gun assembly 468 and well treatment assembly 470 are conveyed into the well, since the gun's outer diameter is larger than the inner bore of the packer. However, after the gun 474 has been fired, it is permitted to pass through the packer 472.

The perforating gun 474 as depicted in FIG. 27A includes an outer case 484 which is constructed at least partially of an explosive or propellant material. A fluid barrier 486, such as a membrane, an impervious coating, etc., outwardly covers the outer case 484 and prevents contact between the outer case material and fluid in the well. Note that, although the outer case 484 is shown in FIG. 27A as being made wholly of an explosive or propellant material, it is to be clearly understood that only a portion of an outer case of a perforating gun may be made of an explosive or propellant material in keeping with the principles of the present invention. One of the objectives of constructing the outer case 484, or at least a portion thereof, of a propellant or explosive material is to burn or detonate the outer case material when the gun 474 is fired, so that an outer dimension of the gun, such as its width or diameter, is reduced after the gun is fired.

The outer case 484 has perforating charges 488 integrally formed therewith. As used herein, the term "integrally formed" means that the outer case 484 and perforating charges 488 are of unitary construction. This result may be accomplished, for example, by forming the outer case 484 with generally conical or dish-shaped depressions therein. The depressions may then be provided with metallic liners, if desired. Although the outer case 484 is shown in FIG. 27A as being a singular structure, it is to be understood that the outer case may be made in sections, such as axially stacked sections, or in segments, such as circumferentially distributed segments, without departing from the principles of the present invention.

An inner support structure, such as an elongated tubular member 494, may be included in the gun 474 and used to provide rigidity to the gun, provide a means of connecting the gun to the firing head 476, another gun, etc. In the method 466, the support member 494 is generally tubular and is centrally disposed within the outer case 484, but it is to be understood that the support member could be otherwise configured and positioned in the gun 474. For example, the support member 494 could be a skeletal frame molded within the gun 474.

When the firing head 476 is actuated, the outer case 484 detonates or burns, thereby causing the charges 488 to form perforations 490 extending outwardly into a formation 492 intersected by the well, as depicted in FIG. 27B. Such detonation or burning of the outer case 484 also decreases the outer dimension or diameter of the gun 474 so that the remainder of the gun may be displaced through the packer 472. FIG. 27B depicts the remainder of the gun 474, the support member 494, displacing downwardly through the packer 472. The well treatment assembly 470 may now be positioned opposite the perforations 490.

Note that, after firing the gun 474, the gun may be displaced downwardly through the packer 472, or it may be retrieved upwardly through the well treatment assembly 470 in a manner similar to retrieval of perforating guns after firing described in the methods above, so that the gun is not left in the well. In downwardly displacing the gun 474 through the packer 472, the gun may be dropped through the packer, pushed through the packer by lowering the well treatment assembly 470 in the well, etc.

Figure 28:
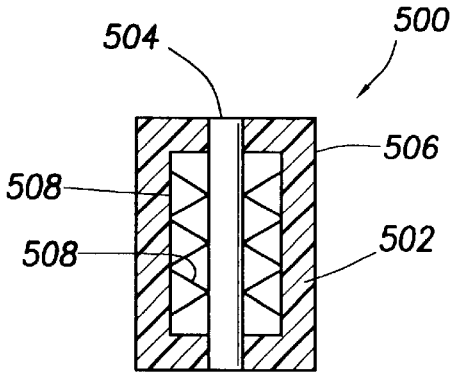
FIG. 28 is a schematic view of an alternate configuration of a perforating gun in the fourteenth well completion method and system.

Referring additionally now to FIG. 28, an alternate construction of a perforating gun 500 which may be used in the method 466 is representatively and schematically illustrated. The perforating gun 500 includes an outer case 502 made of an explosive or propellant material and an inner support member 504. The outer case 502 may be covered with a fluid barrier 506, such as a membrane, coating, etc., to prevent contact between the outer case and fluid in the well.

Note, however, that the outer case 502 does not have perforating charges integrally formed therewith. Instead, separate perforating charges 508 are disposed inside the outer case 502. For example, the perforating charges 508 may be positioned between the outer case 502 and the support member as shown in FIG. 28. As another example, the separate perforating charges 508 may be distributed within the outer case 502 material, with a skeletal frame support member interconnecting the perforating charges. Thus, it will be readily appreciated that a variety of perforating gun configurations may be utilized in the method 466, without departing from the principles of the present invention.

When the gun 500 is fired, its outer diameter is reduced, so that it may be displaced downwardly through the packer 472, or it may be displaced upwardly through the well treatment assembly 470. However, it is to be understood that either of the guns 474, 500 may be displaced through other restrictions in the well after being fired, in keeping with the principles of the present invention.

Of course, many modifications, additions, deletions, substitutions, and other changes may be made to the methods, systems, apparatus, etc. described above, which changes would be readily apparent to a person skilled in the art upon careful consideration of the above description of certain embodiments of the present invention, and these changes are contemplated by the principles of the present invention. For example, the principles of the present invention are not restricted by the particular number and arrangement of perforating guns, firing heads, packers and other equipment described above, since any number and arrangement of equipment may be utilized in methods and systems embodying principles of the present invention. Accordingly, the foregoing detailed description is to be clearly understood as being given by way of illustration and example only, the spirit and scope of the present invention being limited solely by the appended claims.

What is claimed is:

1. A method of completing a well, the method comprising the steps of:

firing a perforating gun by applying at least one fluid pressure to a firing head of the gun;

then arming a packer attached to a well screen by applying at least one subsequent fluid pressure to at least a portion of the well; and displacing the gun through an inner passage of the well screen after the firing step.

2. The method according to claim 1, further comprising the step of setting the packer by applying fluid pressure to the packer after the arming step.

3. The method according to claim 1, further comprising the step of installing the gun, screen and packer in the well in a single trip into the well.

4. The method according to claim 1, wherein the arming step further comprises opening a valve in response to a signal comprising a series of pressure pulses transmitted from a remote location to a receiver.

5. The method according to claim 1, wherein the arming step further comprises displacing a member of the packer in response to a signal comprising a series of pressure pulses transmitted from a remote location to a receiver.

6. A method of completing a well, the method comprising the steps of:

firing a perforating gun by applying at least one fluid pressure to a firing head of the gun; and then arming a packer attached to a well screen by applying at least one subsequent fluid pressure to at least a portion of the well, and permitting fluid communication between an inner fluid passage of the packer and a portion of the well by displacing a member incrementally in response to each of multiple ones of the subsequent fluid pressure applications.

7. A well completion system, comprising:

at least one perforating gun operative to fire in response to application of fluid pressure to a firing head attached thereto; and a well treatment assembly including a packer and a well screen, the packer being settable by application of fluid pressure thereto after the gun has been fired, wherein the packer is armed by applying a series of fluid pressures to a tubular string in which the packer is interconnected, and wherein each of the series of fluid pressure applications causes a member of the packer to incrementally displace.

8. The well completion system according to claim 7, wherein a predetermined number of the fluid pressure applications causes the member to displace sufficiently far to permit fluid communication between the tubular string and an internal piston of the packer.

9. A well completion system, comprising:

at least one perforating gun operative to fire in response to application of fluid pressure to a firing head attached thereto; and a well treatment assembly including a packer and a well screen, the packer being settable by application of fluid pressure thereto after the gun has been fired, and wherein firing of the gun arms the packer.

10. A well completion system, comprising:

at least one perforating gun operative to fire in response to application of fluid pressure to a firing head attached thereto; and a well treatment assembly including a packer and a well screen, the packer being settable by application of fluid pressure thereto after the gun has been fired, and wherein the packer is armed by applying a series of multiple fluid pressures to a tubular string in which the packer is interconnected.

11. A well completion system, comprising:

at least one perforating gun operative to fire in response to application of fluid pressure to a firing head attached thereto; and a well treatment assembly including a packer and a well screen, the packer is set by application of fluid pressure thereto after the gun has been fired, and wherein the packer is set in response to a signal transmitted to a receiver from a remote location.

12. A well completion system, comprising:

at least one perforating gun operative to fire in response to application of fluid pressure to a firing head attached thereto; and a well treatment assembly including a packer and a well screen, the packer is set by application of fluid pressure thereto after the gun has been fired, and wherein the packer is armed in response to a signal transmitted to a receiver from a remote location.

13. The well completion system according to claim 12, wherein reception of the signal by the receiver causes a valve of the packer to open.

14. A well completion system, comprising:

at least one perforating gun operative to fire in response to application of fluid pressure to a firing head attached thereto; and a well treatment assembly including a packer and a well screen, the packer being settable by application of fluid pressure thereto after the gun has been fired, and wherein the well completion system comprises a plurality of the perforating guns, the guns being sequentially firable in response to fluid pressure applied via a line to a corresponding plurality of firing heads, each firing head being attached to at least one of the perforating guns.

15. The well completion system according to claim 14, wherein the packer is settable by applying fluid pressure to the line.

16. The well completion system according to claim 14, wherein the well screen is positioned in the well opposite a zone of the well sequentially perforated by at least two of the perforating guns.

17. The well completion system according to claim 14, wherein the well screen is positioned in the well opposite at least two zones of the well, each of the zones being perforated by at least one of the perforating guns.

* * * * *